US011124274B2

(12) United States Patent
Høstmark et al.

(10) Patent No.: US 11,124,274 B2
(45) Date of Patent: Sep. 21, 2021

(54) SMART GANGWAY TIP

(71) Applicant: Kongsberg Maritime AS, Kongsberg (NO)

(72) Inventors: Jon Bernhard Høstmark, Kongsberg (NO); Jostein Bakkeheim, Drammen (NO)

(73) Assignee: Kongsberg Maritime AS, Kongsberg (NO)

( * ) Notice: Subject to any disclaimer, the term of this patent is extended or adjusted under 35 U.S.C. 154(b) by 0 days.

(21) Appl. No.: 16/647,929

(22) PCT Filed: Sep. 20, 2018

(86) PCT No.: PCT/EP2018/075457
§ 371 (c)(1),
(2) Date: Mar. 17, 2020

(87) PCT Pub. No.: WO2019/057813
PCT Pub. Date: Mar. 28, 2019

(65) Prior Publication Data

US 2020/0262521 A1 Aug. 20, 2020

(30) Foreign Application Priority Data

Sep. 22, 2017 (NO) ..... 20171521

(51) Int. Cl.
*E01D 15/00* (2006.01)
*B63B 27/14* (2006.01)
(Continued)

(52) U.S. Cl.
CPC ..... *B63B 27/14* (2013.01); *E01D 15/24* (2013.01); *B63B 21/00* (2013.01); *B63B 27/30* (2013.01);
(Continued)

(58) Field of Classification Search
CPC ..... E01D 15/22; B63B 21/00; B63B 27/14; B63B 27/143; B63B 27/30; B63B 2017/0072; B63B 2027/141
(Continued)

(56) References Cited

U.S. PATENT DOCUMENTS 3,468,280 A * 9/1969 Williams ..... B63B 27/143 114/72
3,879,784 A * 4/1975 Kummerman ..... B63B 27/143 14/71.1
(Continued)

FOREIGN PATENT DOCUMENTS

DE 3503836 A1 10/1986
GB 2167714 A 6/1986
(Continued)

OTHER PUBLICATIONS

Knoflacher, Nikolaus; International Search Report; PCT/EP2018/075457; dated Dec. 4, 2018; 5 pages.

*Primary Examiner* — Raymond W Addie
(74) *Attorney, Agent, or Firm* — Shackelford, Bowen, McKinley & Norton, LLP

(57) ABSTRACT

A gangway includes a distal end on which an end effector unit is attached. The end effector unit has an outer surface at least a certain portion of which is adapted to be in contact with an installation, wherein a movement of a rotatable element in the end effector unit corresponds to a movement of the distal end with respect to a reference point on the installation when the end effector unit is in contact with the installation, the movement of the distal end being at least along one of the axes related to the installation. A method for repositioning a gangway to a desired position on an installation or a target structure. A vessel or a watercraft includes the gangway and an installation includes the gangway. A
(Continued)

Figure 1:
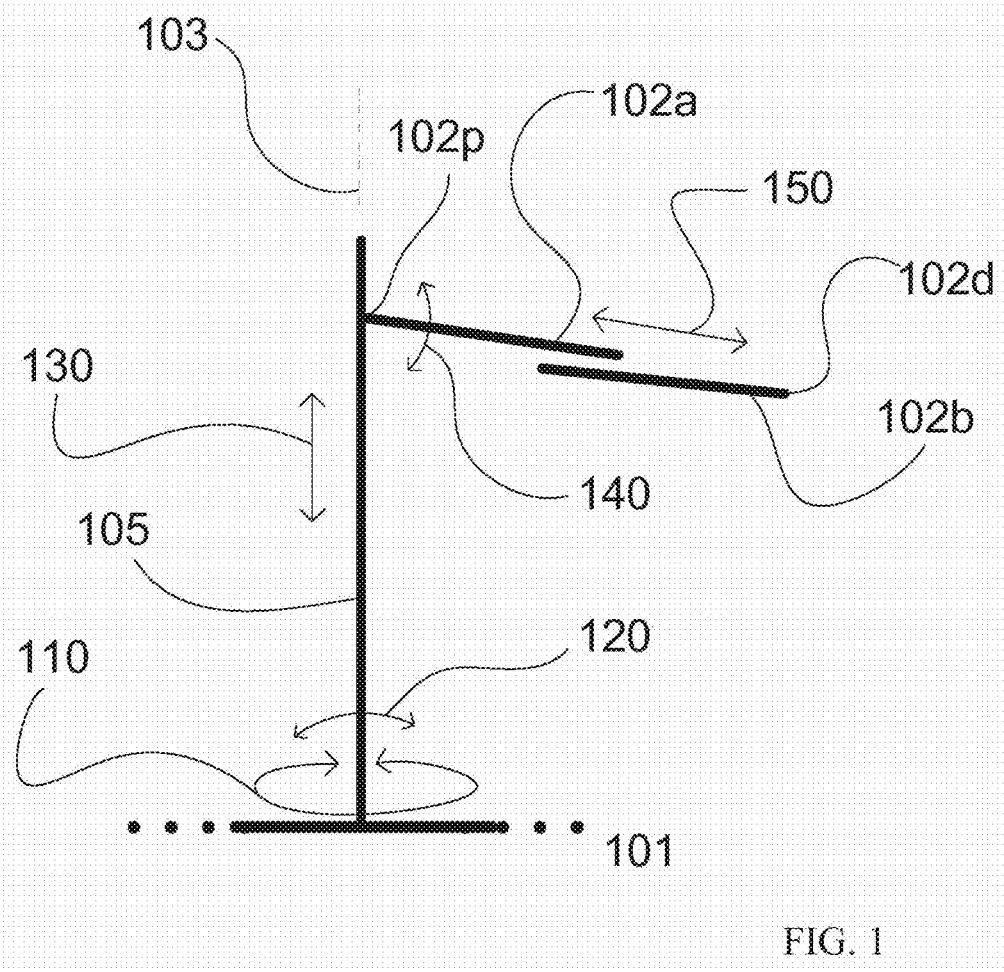

computer software product implements method steps herein disclosed.

20 Claims, 17 Drawing Sheets

(51) Int. Cl.
*E01D 15/24* (2006.01)
*B63B 21/00* (2006.01)
*B63B 27/30* (2006.01)
*B63B 17/00* (2006.01)

(52) U.S. Cl.
CPC . *B63B 2017/0072* (2013.01); *B63B 2027/141* (2013.01)

(58) Field of Classification Search
USPC ..... 114/71.5; 414/263
See application file for complete search history.

(56) References Cited

U.S. PATENT DOCUMENTS 5,226,204 A * 7/1993 Schoenberger ..... E01D 15/24 14/71.5
6,724,314 B2 * 4/2004 Hutton ..... B64F 1/3055 14/69.5
6,898,816 B2 * 5/2005 Tholen ..... B64F 1/3055 14/69.5
7,543,542 B2 * 6/2009 Jakobsson ..... B63B 27/143 114/230.1
7,690,065 B2 * 4/2010 Muller ..... B64F 1/305 14/71.5
8,302,237 B2 * 11/2012 Shimizu ..... B64F 1/3055 14/71.5
8,925,130 B2 * 1/2015 Bedford ..... B63B 27/30 14/69.5
8,959,694 B2 * 2/2015 Clarke ..... E01D 15/08 14/71.3
9,121,148 B2 * 9/2015 Johnson ..... E01C 11/24
9,643,690 B2 * 5/2017 Hessels ..... B63B 27/30
10,392,083 B2 * 8/2019 Van Aalst ..... B63B 27/30
2003/0145404 A1 * 8/2003 Hutton ..... B64F 1/3055 14/71.5
2004/0237224 A1 * 12/2004 Hutton ..... B64F 1/002 14/71.5
2007/0028404 A1 * 2/2007 Hutton ..... B64F 1/305 14/71.5
2008/0099967 A1 * 5/2008 Spratte ..... B60G 17/01933 267/140.14
2008/0109970 A1 * 5/2008 Hutton ..... B64F 1/002 14/71.5
2008/0229525 A1 * 9/2008 Hutton ..... B64F 1/002 14/71.5
2011/0119842 A1 * 5/2011 Park ..... B64F 1/3055 14/71.1
2012/0030887 A1 * 2/2012 Corboy ..... B63B 27/14 14/71.3
2015/0158559 A1 * 6/2015 Mueller ..... B63B 27/36 114/363
2016/0144932 A1 * 5/2016 Salen ..... E01D 18/00 700/275
2016/0375813 A1 * 12/2016 Colantonio ..... B60P 1/02 211/85.8
2020/0172204 A1 * 6/2020 Robertson ..... B63B 27/143
2020/0239111 A1 * 7/2020 Zijlmans ..... B63B 27/14

FOREIGN PATENT DOCUMENTS

WO WO-99053144 A1 10/1999
WO WO-2000015489 A1 3/2000
WO WO-2011154730 A2 12/2011
WO WO-2012069825 A1 5/2012
WO WO-2013174886 A1 11/2013

* cited by examiner

SMART GANGWAY TIP

The present teachings relate to a gangway for transferring personnel or equipment to or from a vessel.

Gangway operations are frequently used for transferring personnel and goods between floating vessels and other fixed or floating structures. In the wind energy business, gangway transfer is one of the most common ways to transfer personnel, equipment or goods between a service vessel and wind turbines for maintenance tasks. It is also a common way of transferring personnel between offshore floatels and other fixed or floating structures.

In offshore gangway operations, often persons with little or no experience at sea need to be transferred using gangways. An increased comfort and safety is of significant value for the operators. An increase in the operational window of a gangway may not only relax requirements from the operator, but may also reduce the constraints on the conditions in which a vessel and the gangway is allowed to be operated, thereby increasing productivity and availability.

When transferring personnel to or from a vessel and an offshore platform or installation, for example, for commissioning or maintenance of windfarm installations, a gangway is used to bridge the vessel with the installation. The gangway is usually installed on the vessel. Often, the gangway is motion compensated such that the distal end of the gangway has a minimal or ideally no movement relative to the landing point on the installation. The distal end of the gangway may alternatively be called the gangway tip.

One of the challenges in maintaining a safe condition while bridging is to ensure that the gangway tip will not drift or slide off the landing point or area, especially during personnel or cargo transfer. Different methods are possible to ensure such a safe operation. The three main are:

1. Hovering: In which, the gangway is hovering a short distance away from the landing area on the installation. The distal end or tip of the gangway does not make a physical contact with the installation, except for example, a simple lip or plate that is provided to prevent personnel or equipment from being caught or falling within the gap between the tip and the installation. Such a lip or plate is provided just as a safety feature rather than an operational one.
2. Physical lock: In which, the gangway tip is clamped on or mechanically engaged to a suitable structure or mechanism on the installation such that the tip is mechanically locked in place to a desired point on the installation.
3. Bumper: In which, the gangway tip is pushed towards the landing platform or site with a given horizontal force. The horizontal force engages the gangway tip with the landing site on the installation through a frictional coupling between the tip and the landing site.

Both in the case of the physical lock principle and the bumper principle, the gangway may be realized as a passive type. In the case of a bumper principle, the acting forces, i.e., the lateral and the vertical forces between the tip and the landing site, should be less than the static frictional force between the tip and the landing site for the frictional coupling to be maintained. Similarly, in the case of the physical lock principle, the acting forces should be less than the relevant mechanical limits such that the physical lock between the gangway tip and the installation remains maintained.

In case of hovering principle, one of the main advantages is that it does not require a specific interface or coupling between the gangway and the platform, however maintaining a minimal movement of the tip relative to a reference point on the installation may be difficult without requiring accurate sensors, actuators and/or control system.

Marine environment can be very dynamic, with environmental conditions such as wind speed, wind direction, waves and marine activity, etc., determining the kind of forces that will be acting on the gangway tip. Moreover, factors such as temperature, precipitation, moisture, surface conditions of the tip as well as the landing site decide the coefficient of friction of contact between the gangway tip and the landing site on the installation. A bumper based system generally sets few requirements with regards to the interface between the tip and the landing site, but there is a risk of the acting forces exceeding the static frictional force between the landing site and the gangway tip, thereby resulting in a non-desired movement of the tip, i.e., a slip or a slide-off of the tip. A combination of said environmental conditions and factors and their variations may make it difficult to decide how much horizontal force would be sufficient for maintaining a stable and reliable contact.

As with a bumper based system, a physical lock based system may also allow for a passive gangway control. Since it does not rely on a frictional coupling as the bumper type does, a physical lock is very suitable for wet conditions, where static friction will be reduced as compared to dry conditions. Moreover, the gangway tip is guided and mechanically held in desired position due to the physical lock. However, a disadvantage of this principle is that it requires the landing site to have an interface that is compatible with the gangway tip such that a physical lock may be established. This may require a specific type of gangway for serving installations where a particular kind of landing mechanism is installed, and thereby restricting the flexibility in serving different kinds of installations using the same service vessel. Additionally, typical realizations of the physical lock result in a step between the gangway and the installation, thereby making it difficult to transfer cargo such as pallets.

At least some of the problems inherent to the prior-art will be shown solved by the features of the present invention as specified in the independent claims.

Further features and combinations consistent with the present teachings will become apparent from the following detailed description of features, which can be combined so as to form further arrangements within the scope of the present disclosure that are not explicitly set out herein.

In this disclosure, the terms distal end of the gangway, distal end of the passageway, tip of the gangway, and tip of the passageway are used interchangeably. Furthermore, the terms walking bridge and passageway are used interchangeably without affecting the scope or generality of the invention.

Example arrangements are described hereinafter with reference to the accompanying drawings. The drawings included in the present disclosure are not necessarily drawn to scale, that being non-limiting to the scope or generality of the inventions disclosed herein.

FIG. 1 shows an example of an articulated gangway with five degrees of freedom ("DoFs")

Figure 2:
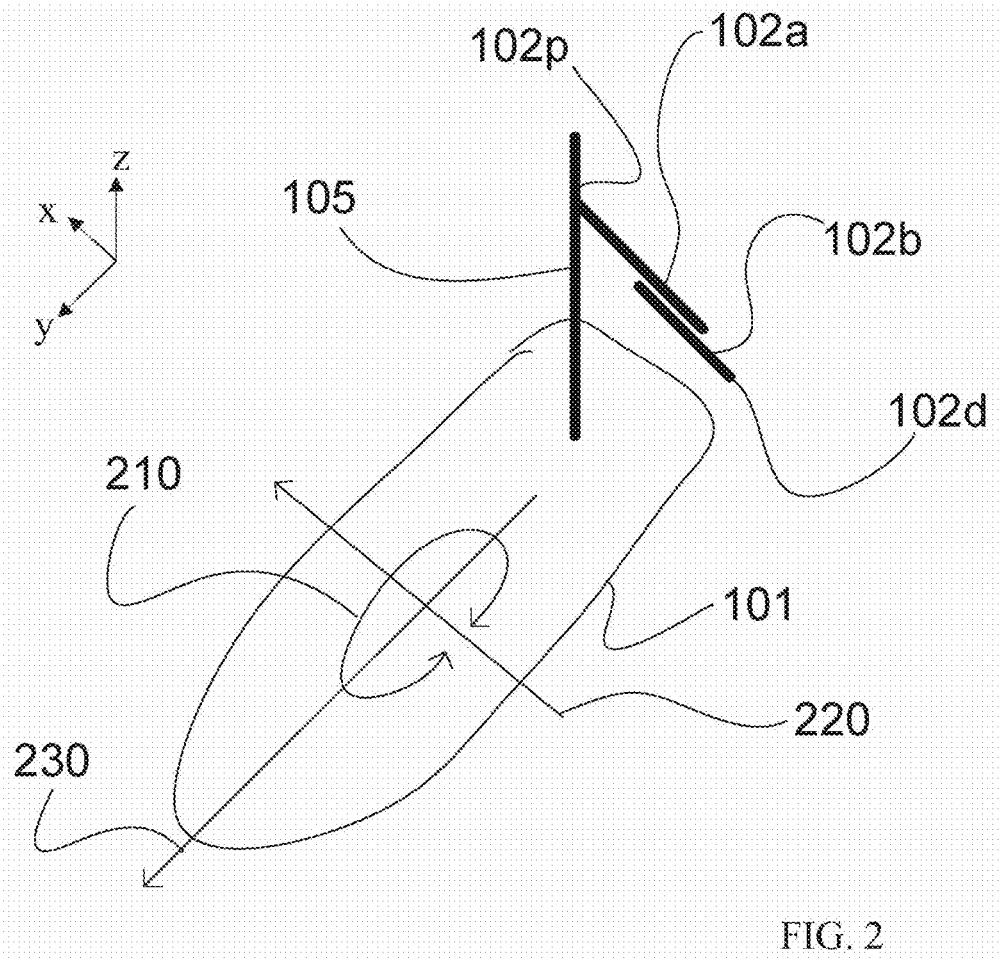
Figure 3:
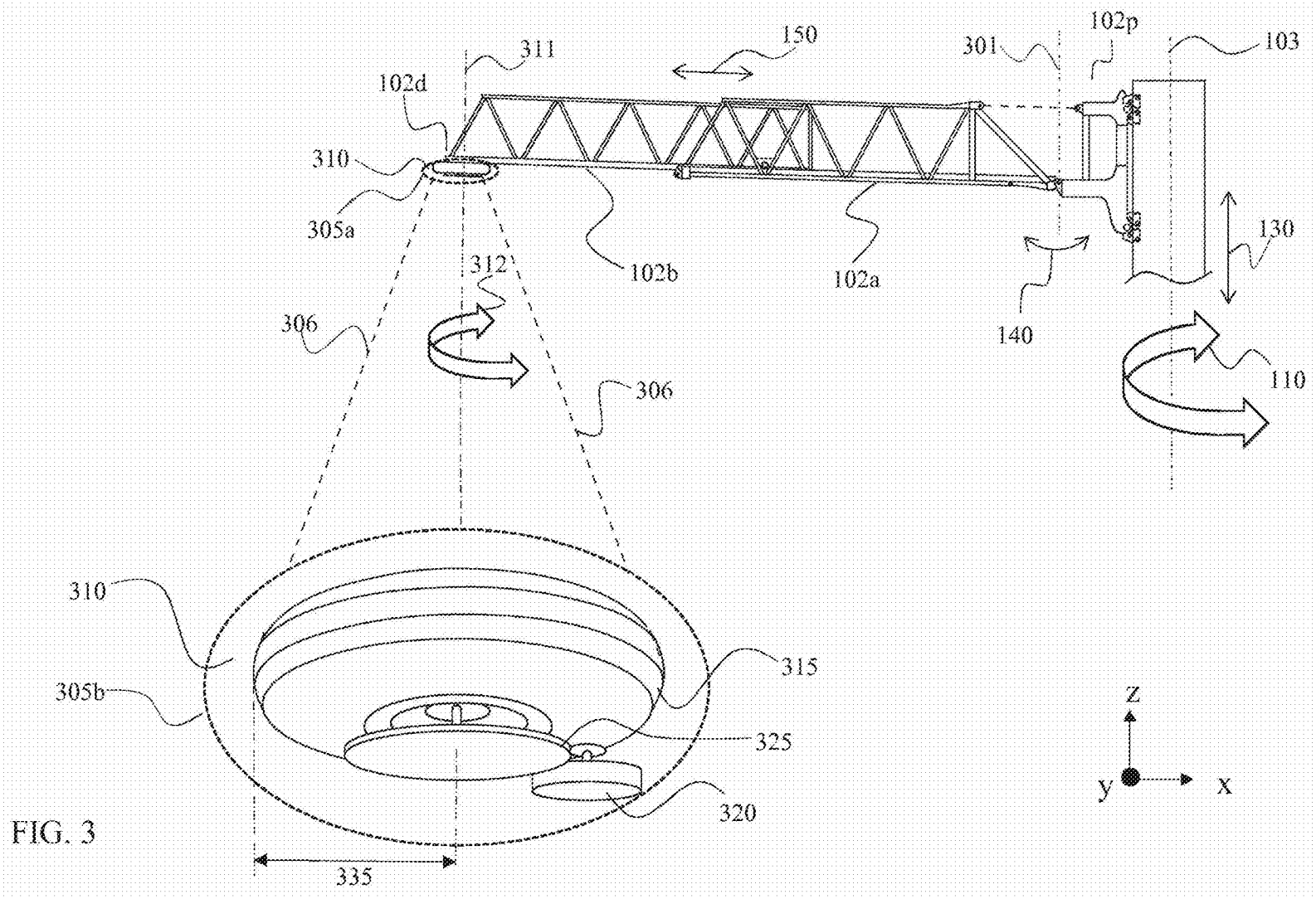
Figure 4A:
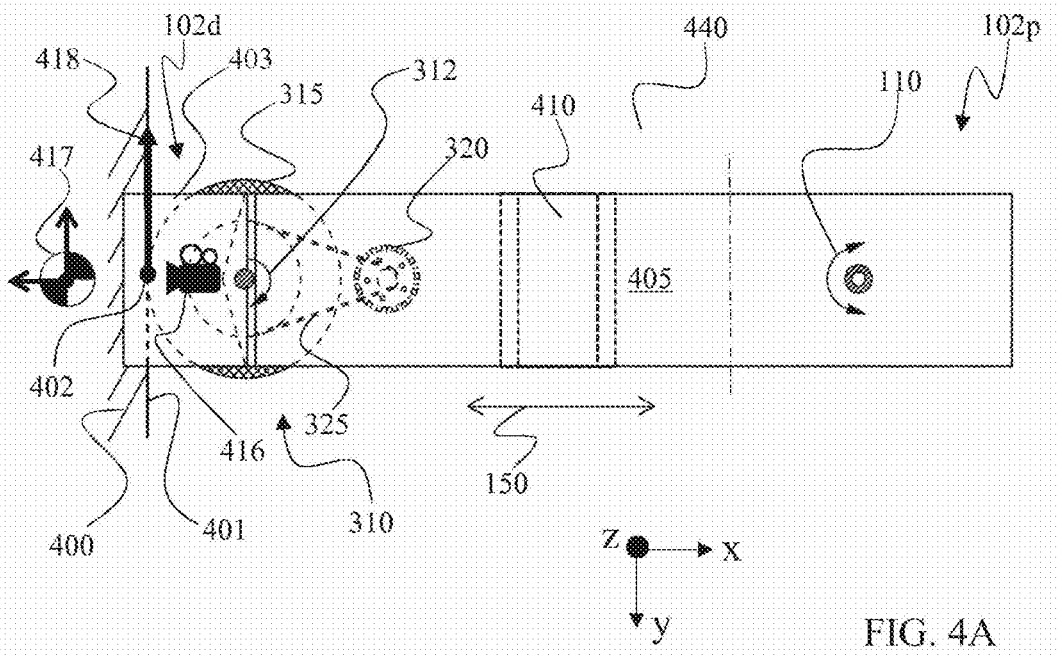
Figure 4B:
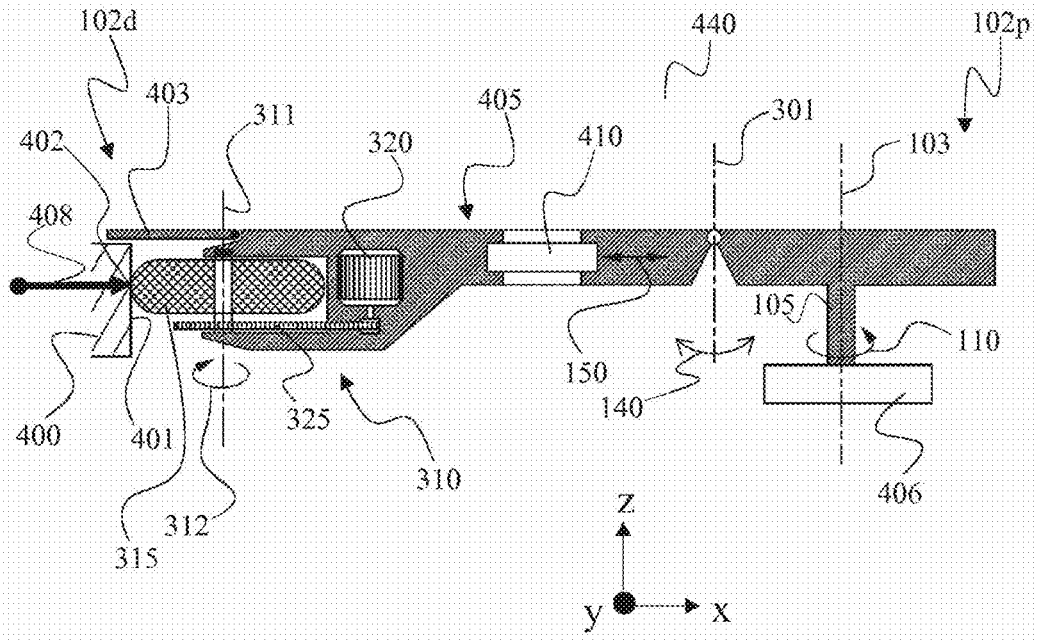
Figure 4C:
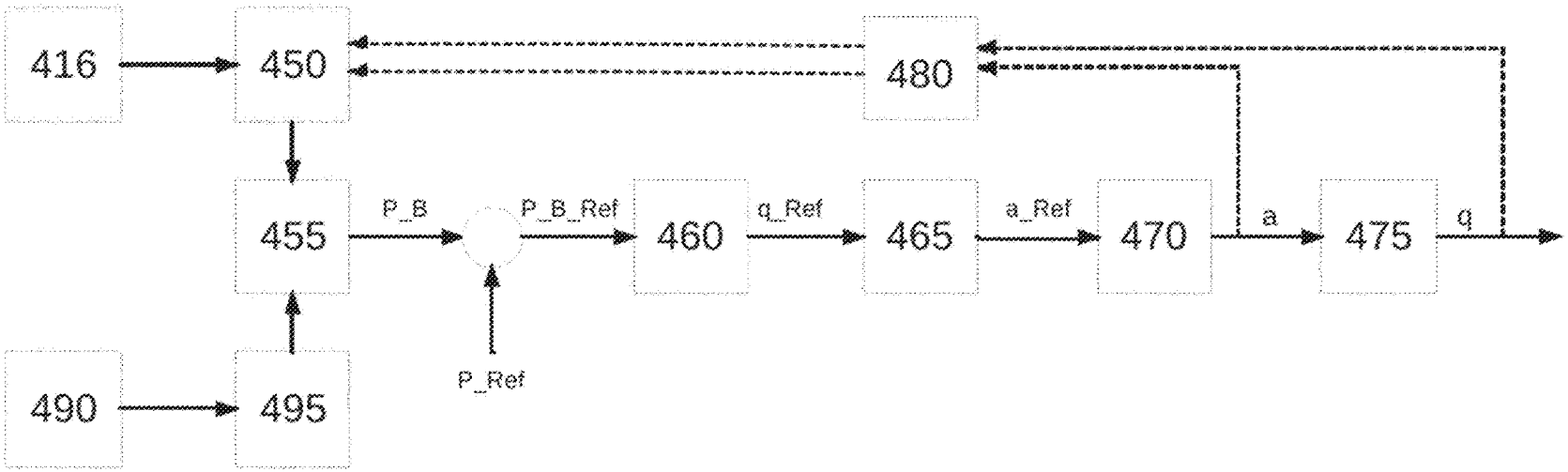
Figure 5:
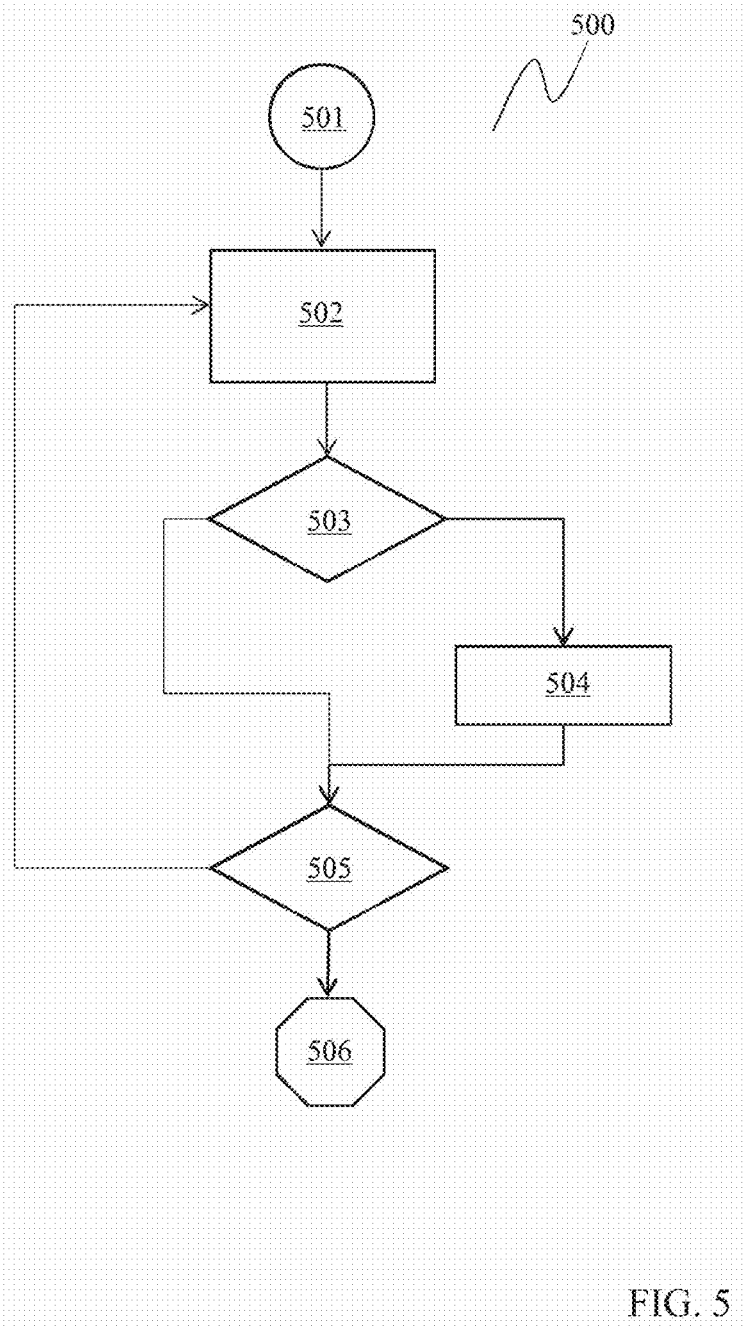
Figure 6:
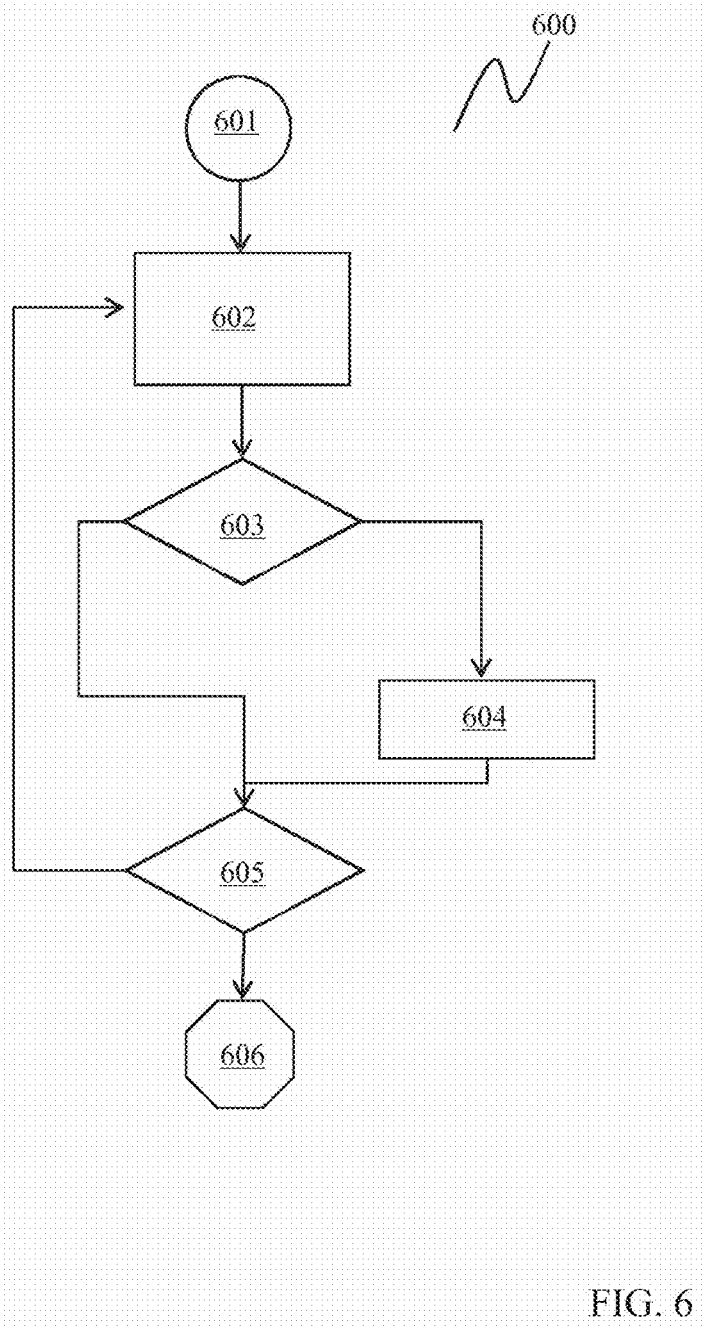
Figure 7:
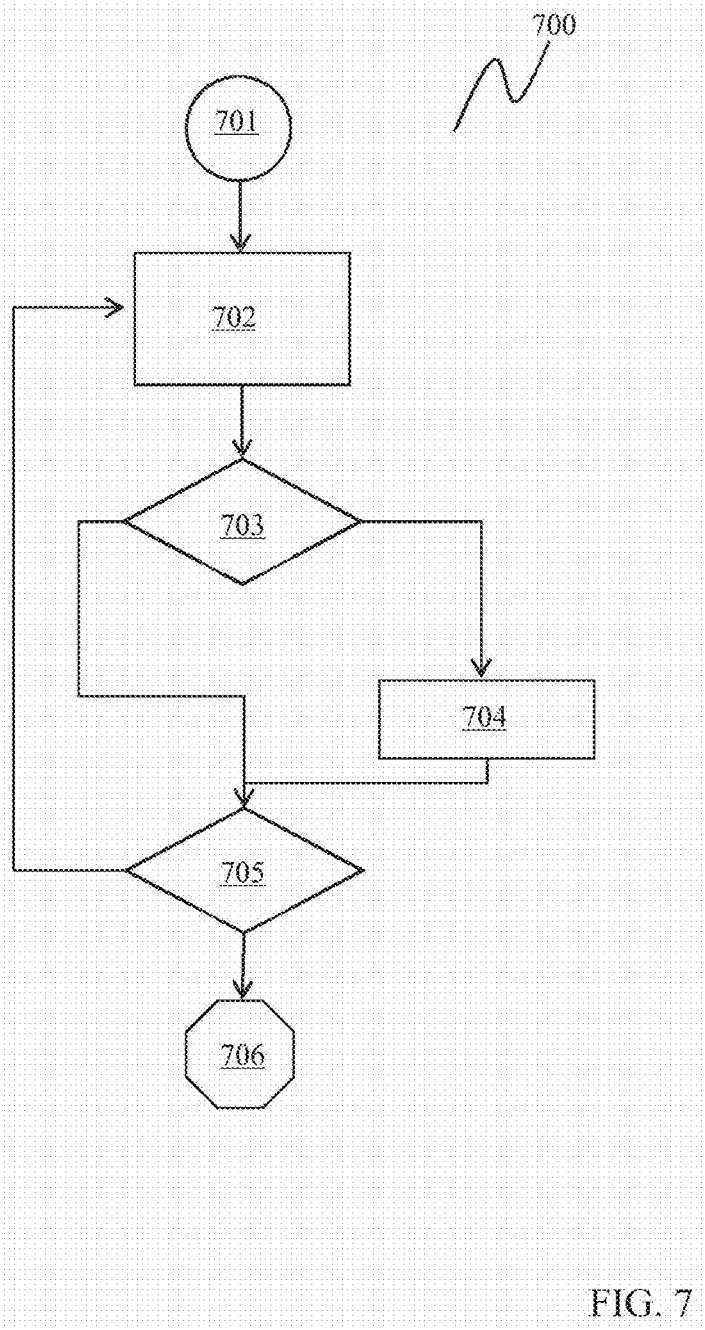
Figure 8:
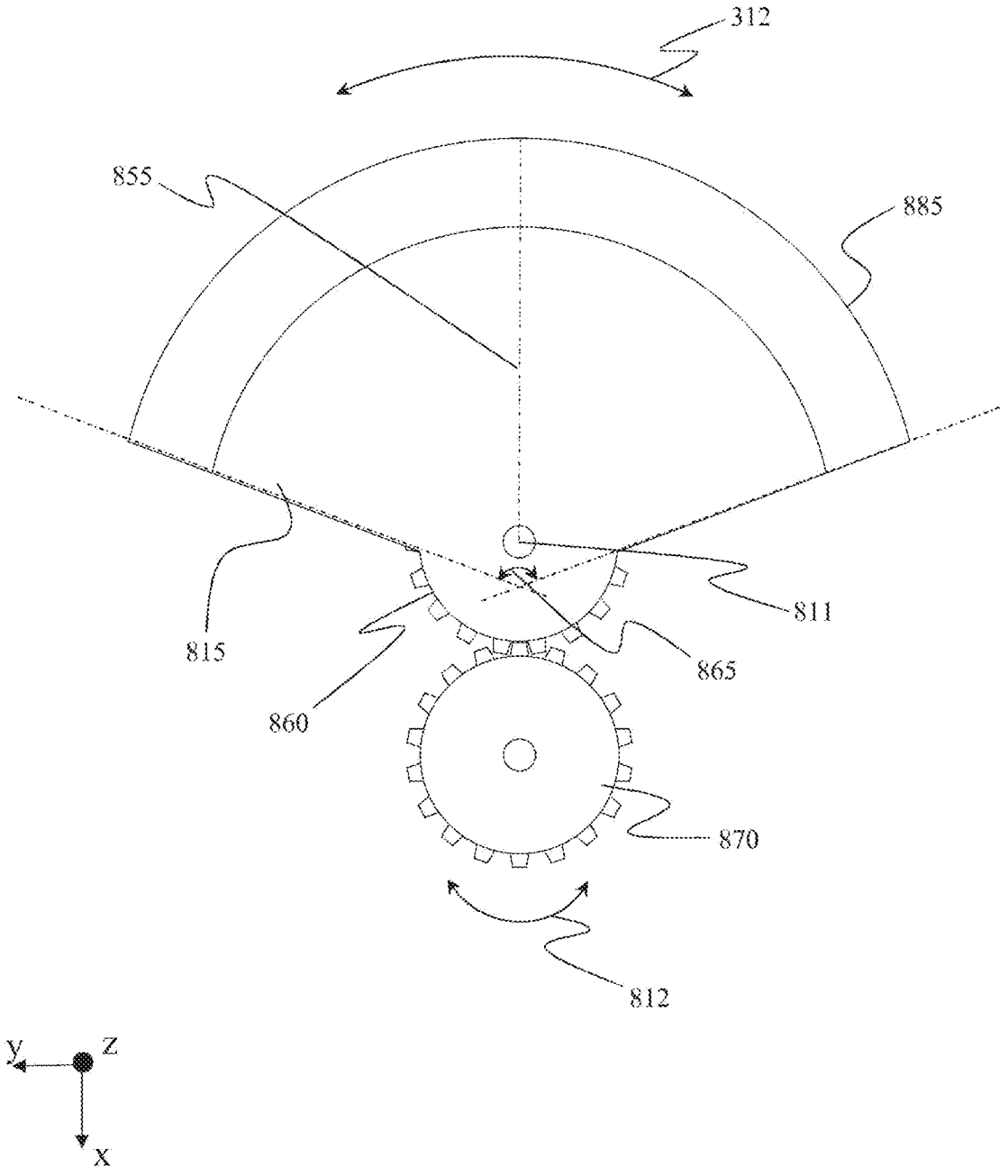
Figure 9A:
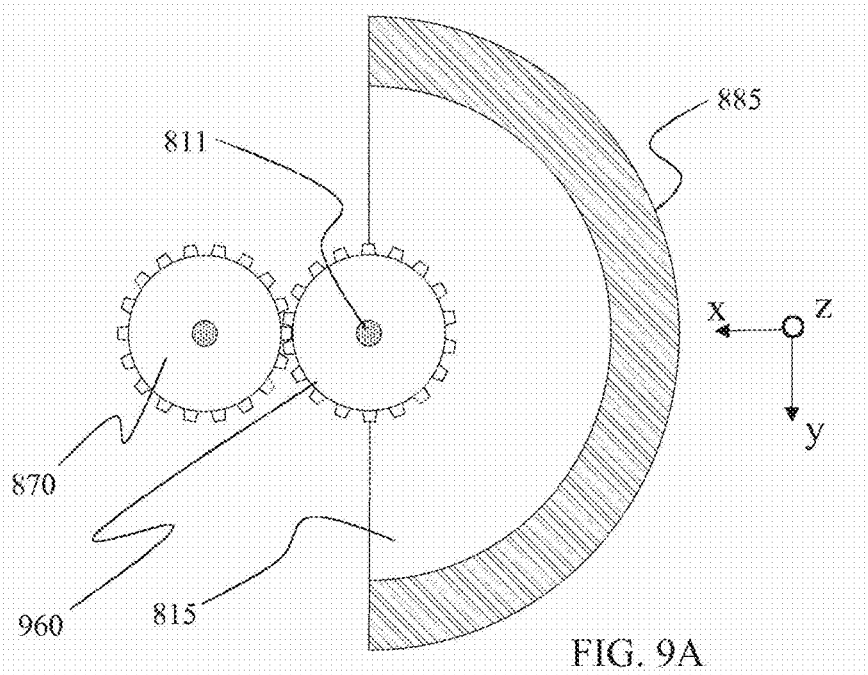
Figure 10:
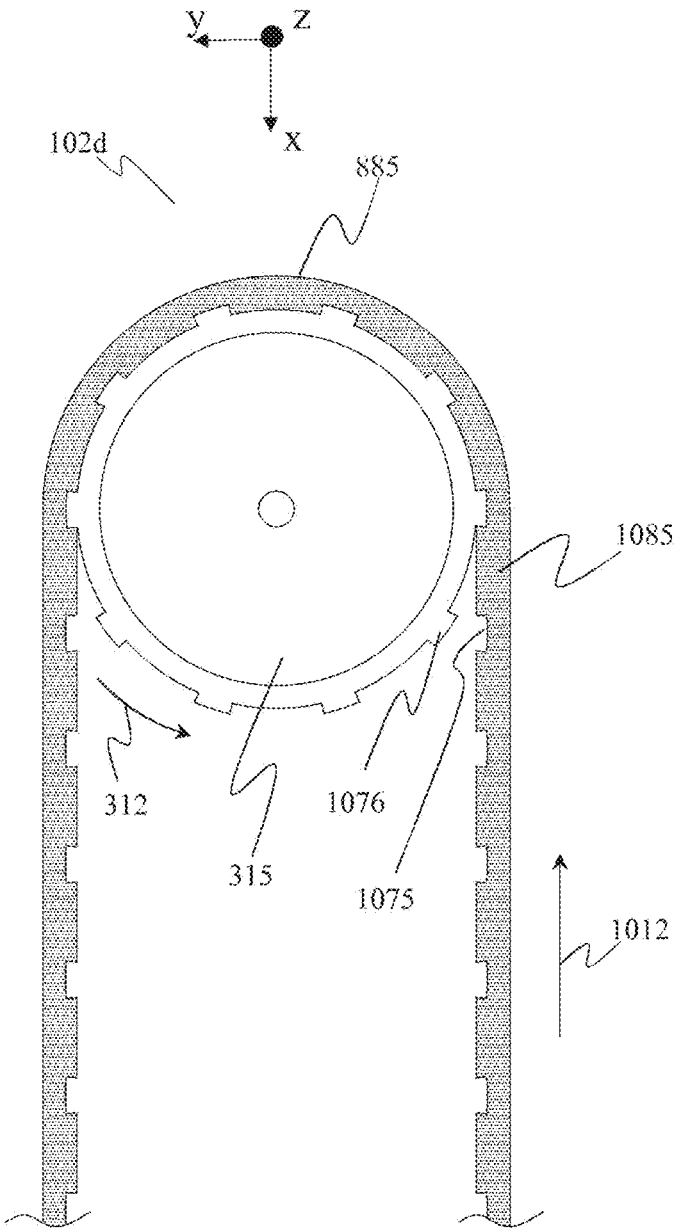
Figure 11A:
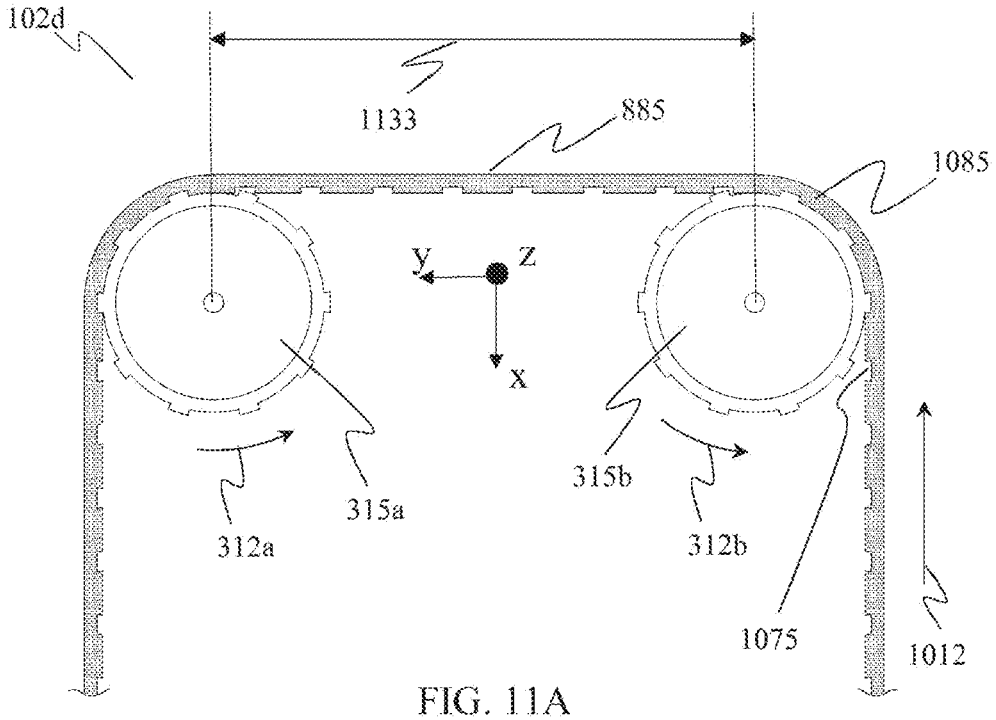
Figure 12A:
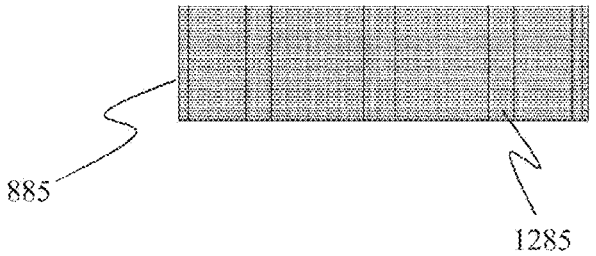
Figure 12B:
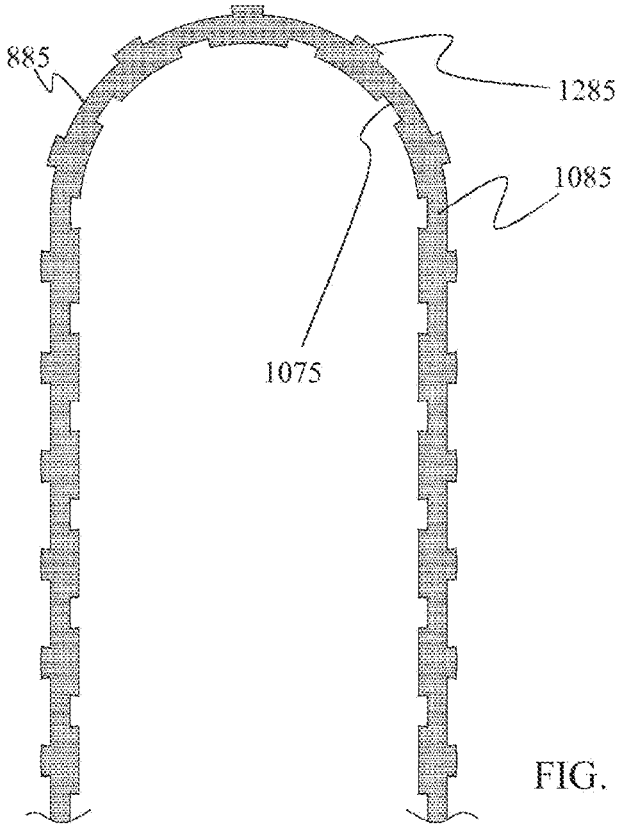
Figure 12C:
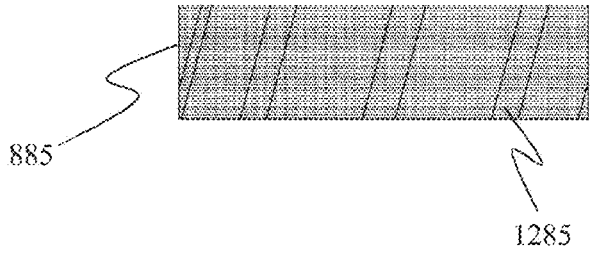
Figure 13:
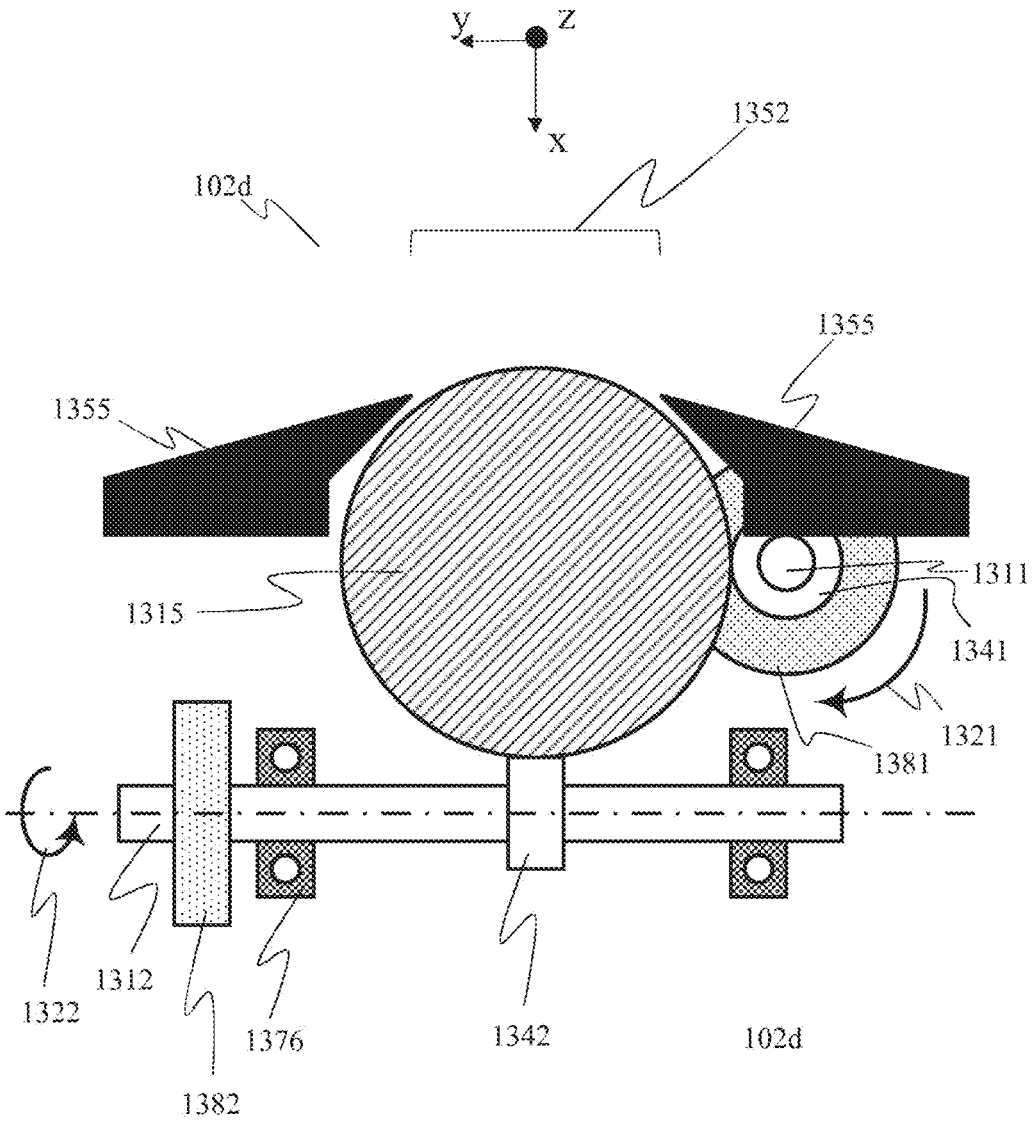
Figure 14A:
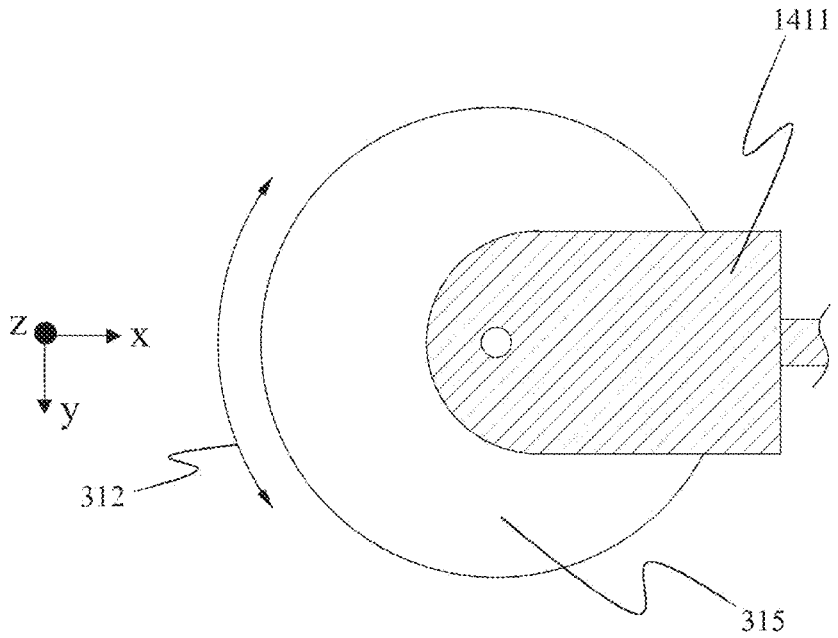
Figure 15:
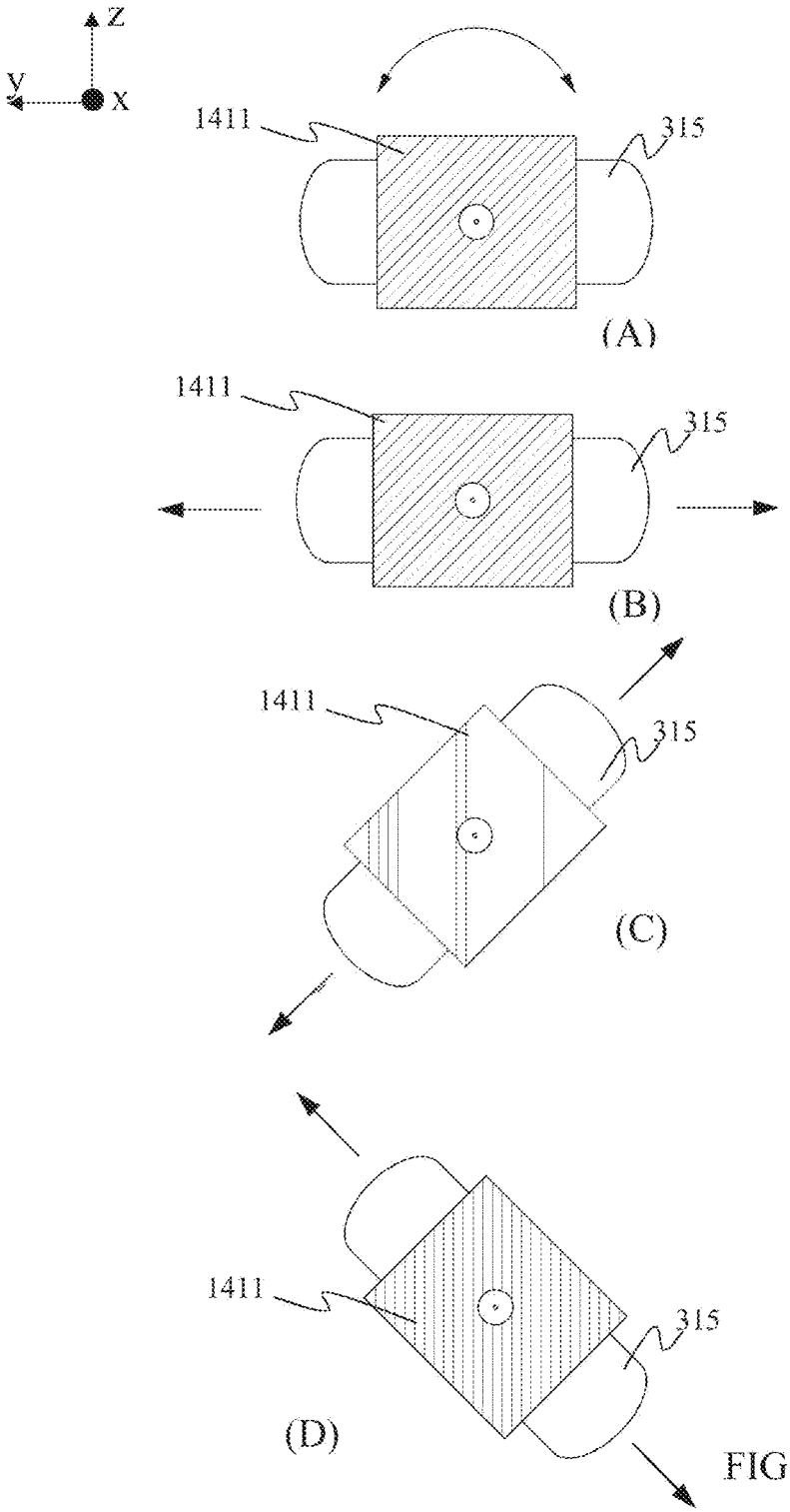
Figure 16:
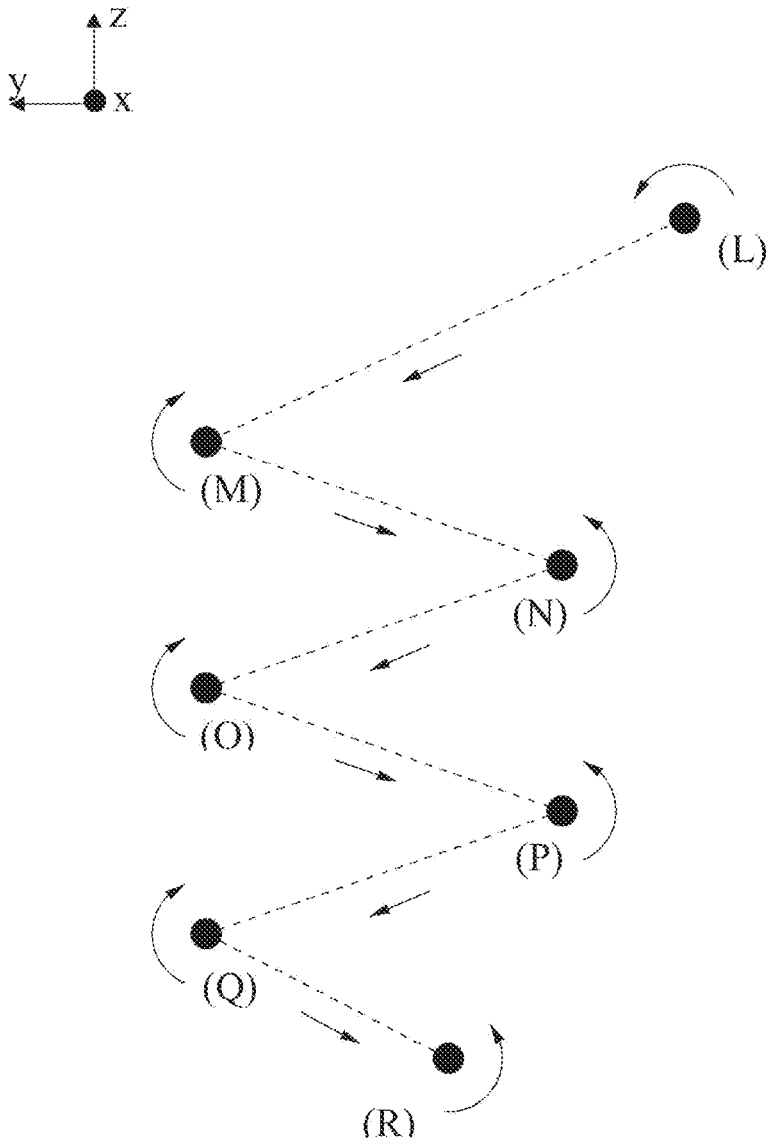

FIG. 2 illustrates an articulated gangway mounted on a vessel and at least some DoFs of the vessel FIG. 3 illustrates an articulated gangway with a wheel unit mounted at the distal end of the gangway FIG. 4A illustrates a top view of a gangway with an end effector FIG. 4B illustrates a side view (FIG. 4B) of the gangway with an end effector shown in FIG. 4A FIG. 4C illustrates a block diagram for a landing process using a camera as secondary position sensor FIG. 5 is a flowchart of transversal force control FIG. 6 is a flowchart of lateral force control FIG. 7 is a flowchart of tip position control FIG. 8 shows a semi-wheel end effector FIGS. 9A,B show a variation of the semi-wheel end effector and its side-view respectively FIG. 10 shows an end effector with belt as outer surface FIG. 11A, B show a variation of an end effector with multiple wheels, and a deployed view of the end effector with multiple wheels FIG. 12A-C show certain variations of the belt FIG. 13 shows multi-dimensional end effector using a ball as rotatable element FIG. 14A,B show a wheel based end-effector mounted in a fork for achieving multi-dimensional movements FIG. 15 shows certain movements achievable using the wheel based end-effector mounted in a fork FIG. 16 shows a method for vertically relocating the fork end effector without requiring a disconnection from the installation FIG. 1 illustrates an example of a gangway, or more specifically an articulated gangway with five degrees of freedom (110, 120, 130, 140 and 150). The gangway comprises a pedestal 105 is mounted on a vessel 101, for example on a ship deck of the vessel 101. The gangway also comprises a passageway or a walking bridge 102. The proximal end 102*p* of the passageway 102 is connected to the pedestal 105. The passageway 102 in this case is shown in two sections; 102*a* towards the proximal end 102*p*, and 102*b* at the distal end 102*d* of the passageway 102. The five degrees of freedom of the gangway illustrated here are,

- Slew or rotational movement 110 around the axis 103 of the pedestal,
- Tilt or pivotal movement 120 of the pedestal 105 relative to a perpendicular to the surface of the vessel 101,
- Heave or vertical movement 130 along the axis of the pedestal 105,
- Luffing or pivotal movement 140 of the passageway 102 relative and essentially perpendicular to the axis 103 of the pedestal 105, and
- Transversal or linear motion 150 for adjusting the linear distance between the proximal end and the distal end of the passageway 102

To further elaborate the luffing movement 140 of the passageway 102 relative and essentially perpendicular to the axis 103 of the pedestal 105, means here that the passageway, with its proximal end 102*p* attached or connected to the pedestal 105, moves relative to the pedestal 105 such that angle between the axis 103 of the pedestal and the passageway 102 is changed due to said luffing movement 140 of the passageway. Similar comments apply also to the tilt movement 120 of the pedestal. Further, by linear movement 150 for adjusting the linear distance between the proximal end and the distal end of the passageway 102, it is meant that the two sections 102*a* and 102*b* of the passageway or walking bridge can be extended or retracted with respect to each other.

The heave 130 can either be achieved, for example, by an extendible pedestal, such as a telescopic type pedestal, or due to a passageway arrangement that can traverse vertically along the pedestal 105. By the passageway arrangement that can traverse vertically along the pedestal, it is meant that the proximal end 102*p* of the passageway 102 is capable of being moved and positioned vertically, along the axis 103 of the pedestal 105.

Three degrees of freedom are needed to position the distal end 102*d* of the passageway 102 at a given target position. The given target position can be a three dimensional location on a coordinate system with respect to a reference point, the reference point being fixed or variable with respect to the coordinate system.

A person skilled in the art will appreciate that different types of movements defined above can be realized using either or a combination of mechanical arrangements such as hydraulic, pneumatic or electric actuators, cable and winch mechanisms, gear box, or such. It should also be understood that the extension and retraction of the passageway 102 can be achieved, for example, by a telescopic type passageway, or even a lazy-tongs type structure. The passageway 102 may even have more than two sections. A particular choice of a mechanical arrangement or a structure limits neither the scope nor the generality of the present invention. These various degrees of freedom, or joints can be used for compensating undesired movements induced for example by environmental disturbances, as a result holding the gangway substantially stationary with respect to a reference point.

Now referring to FIG. 2, which shows the gangway comprising pedestal 105 and passageway 102 mounted on the vessel 101. In this case, the vessel 101 further has at least 3 degrees of freedom corresponding to the movements yaw 210 around the yaw axis z, sway 220 along the pitch axis y, and surge 230 along the roll axis x respectively. The yaw axis z is essentially parallel to the axis 103 of the pedestal 105 when the pedestal is essentially perpendicular to horizontal deck of the vessel 101. At least three degrees of freedom are available for control; rotation 210 around a vertical axis z, planer movements 220 and 230 along axes x and y respectively. Control of these three degrees of freedom may be done, for example, by using a dynamic positioning ("DP") system. Usually, a marine vessel has six DoFs, however not all are directly controlled. Typically for vessels with DP control, x, y and yaw are controlled.

FIG. 3 shows a perspective side-view of the gangway illustrating an aspect of the present teachings. Accordingly, at least one additional degree of freedom is introduced in the gangway by mounting an end effector unit or a rotatable unit, shown as a wheel unit 310, on the distal end 102*d* of the gangway. The wheel unit 310 is also shown as a magnified view 305*b* of the same portion 305*a* shown mounted at the distal end 102*d* of the gangway. Dotted lines 306 are lead lines indicating that the zoomed-in view 305*b* is corresponding to the other view 305*a*. The bottom side of the zoomed-in view 305*b* has been slightly rotated towards the reader such that an illustration of some of some other elements related to the wheel unit 310 may become visible to the reader. The wheel unit 310 comprises a rotatable element, preferably round, shown as a wheel 315 in FIG. 3. The wheel 315 has a given radius 335. The wheel 315 is rotatable on an axis of rotation 311. The axis of rotation 311 is as shown in the figure is at least substantially parallel to the axis 103 of the pedestal. The wheel unit 310 is mounted at the distal end 102*d* such that the wheel 315 may contact a chosen landing area on an installation when the gangway is deployed on the installation. The installation is not shown in FIG. 3. The wheel 315 is rotatable in such a way that due to its rotation 312 it may tread a certain distance at least horizontally, i.e., at least along the y-axis, on the surface of the installation where the gangway has been deployed and the axis of rotation 311 is at least substantially parallel to the axis 103 of the pedestal. The wheel 315 is preferably rotatable in both directions along the rotation axis 311. The y-axis in FIG. 3 is pointing inwards the drawing sheet showing FIG. 3. When deploying the gangway to the installation, the wheel 315 is pressed towards the surface of the installation along the x-axis with a predetermined transversal force. Said predetermined transversal force may be applied using a transversal force, for example using the transversal movement 150. The transversal movement 150 may, for example, be provided by a prismatic joint. Possible alternatives for providing such a movement have already been explained earlier in this disclosure. Said predetermined transversal force may be determined according to the operating parameters and prevailing conditions. Said prevailing conditions may include parameters such as, environmental factors, marine activity and such. Operational factors may include parameters pertaining to surface conditions of the landing site and those of the wheel 315.

According to another aspect of the present teachings, a feedback loop is used to regulate the predetermined transversal force. Accordingly, the movement caused in the wheel is measured using at least one sensor used for calculating the force with which the wheel is to be pushed towards the landing site. The at least one sensor may be a force sensor and/or it may be a position sensor measuring a position or displacement of/in a mechanism that provides the transversal movement 150. Various possible realizations of the mechanism have been discussed earlier, i.e., it may be prismatic joint or any other kinds of alternatives or their combination. Alternatively or in addition, the at least one sensor may be located in the wheel unit 310. When located in the wheel unit, the at least one sensor may measure the transversal force and/or a position/displacement indicative of the transversal force.

According to another aspect, the wheel unit 310 may be operatively coupled to a position sensor such as a rotary encoder or such for sensing a position of the wheel 315. Alternatively or additionally, the wheel unit 310 may be operatively coupled to a velocity sensor for sensing a velocity of the wheel 315. Alternatively or additionally, the wheel unit 310 may be operatively coupled to a force sensor for sensing a force related to or acting on the wheel 315. Alternatively or additionally, the wheel unit 310 may be operatively coupled an actuator, the actuator being used for effecting a movement the wheel 315. Said effecting of a rotation of the wheel 315 means that the wheel 315 is driven by the actuator, for example, to position the wheel unit at or close to a specific position relative to a reference point. Said reference point may be any fixed point on earth. Alternatively, the reference point may be a point on the installation where the gangway with the wheel unit 310 is to be deployed, for example, for a case where the installation is a floating installation. In such cases, it may be desirable to hold the gangway substantially stationary with respect to the floating installation rather than with respect to a fixed point on earth. It would be obvious to the skilled person that for fixed installations, the reference point anywhere on earth also includes a reference point on the fixed installation. When the actuator, shown here as a rotatable element actuator 320, is an electrical actuator such as an electrical motor, the wheel unit 310 may also include a sensor for measuring current or power to the motor. According to another aspect, the electrical motor may be a stepper motor or such where the displacement of the rotor may be accurately effected by sending a pre-determined drive signal to such a motor. The stepper motor may be a rotary type or a linear type stepper motor.

An output from the position sensor, or any other sensor provided to output an output signal dependent upon the position of the distal end, may be input to a processing unit. The processing unit may compare the output of the sensor with a predetermined reference signal to generate an error signal. As will be understood, the predetermined reference signal here represents a desired position of the distal end. Accordingly, the error signal output from the processing unit can be used to effect a movement in the distal end such that the distal end is aligned substantially at or close to the desired position. By substantially aligned means here that the distal end location is within acceptable tolerance for a successful alignment with the desired position such that an actuator effecting the movement may stop driving the distal end further. If the sensor includes a processing unit, the sensor may provide an output signal dependent upon the position of the distal end with respect the desired position. In some cases, the output signal of the sensor may even be dependent upon to the movement of the rotatable element, e.g., in cases when the position of the distal end is measured with respect to the movement of the rotatable element.

It will be understood that the processing unit can be a module such as a computer processor. The processing unit can be any type of computer processor, such as a DSP, an FPGA, or an ASIC. The processing unit may further comprise a machine learning module. The processing unit may also comprise an artificial intelligent processor. The processing unit may a separate module, or it may even be a part of any of the controllers discussed herein, e.g., DP system controller, gangway controller, end effector unit controller, slew controller, and such. It will further be understood that in some cases the processing unit may be a non-electric module, i.e., based on signals that are not electrical. A skilled person will understand that non-electric controllers also exist in the field of art, such as pneumatic, and hydraulic controllers. Moreover, a combination of non-electric and electric controllers may also be possible.

The movement in the distal end may be effected using the rotatable element actuator 320, or it may be effected using a slew actuator, or it may be effected using a dynamic positioning ("DP") system, or even any combination of these. This and other operating modes will be discussed later in this disclosure.

In FIG. 3, one example of the actuator is shown as an actuator 320. The actuator may be a motor, for example, an electrical motor, an electrical servo system, or it may even be a hydraulic motor, a pneumatic motor, or even their combinations. The actuator 320 or motor may be a rotary type, or even a linear type. In the case of a linear motor, a rotary movement of the wheel 315 may be effected by any suitable conversion system, such as a worm gear system, or a rack and pinion system. When the actuator 320 is rotary type, it may drive the wheel 315 by any suitable coupling system 325. The coupling system 325 may be a gear system, drivetrain, or a gearbox, or it may even be a belt or chain driven system, or a combination thereof. The actuator 320 when being a rotary type actuator, may even share its axle or rotor with that of the wheel. An advantage can be that a separate coupling system 325 may be avoided, thereby saving costs. In another aspect, the actuator 320 may be integrated with the wheel 315. The wheel unit 310 may even comprise a plurality of actuators, for example, for retracting the wheel 315, or even the whole wheel unit 310 where the gangway needs to be deployed at an installation without the end effector or wheel unit 310 functionality. Any additional actuator(s) may be used to adjust the vertical position of the wheel unit 310, for example pre-deployment to an installation, or even post deployment, according to another aspect, for example for fine adjustments to the luffing movements 140. For controlling movements along the z-axis, the wheel 315 may be mounted on a fork with ability to rotate around the x-axis. Alternatively or in addition, the wheel 315 may be an omni-wheel. The wheel 315 may even be composed of a plurality of wheels or omni-wheels, or a belt based system. Further non-limiting examples of end effector unit or rotatable unit types will be provided later in this disclosure.

As already discussed, the installation may either be a fixed installation or a non-fixed installation, such as a floating installation. Alternatively or additionally, the wheel unit may be operatively coupled to an anti-slip system. The anti-slip system may use at least one sensor operatively coupled to the wheel unit 310 to detect a slip condition at the distal end 120*d*. According to another aspect, the anti-slip system may then use an actuator to reposition the wheel unit or the distal end at or close to the previous position where the wheel unit or distal end was prior to the occurrence of the slip condition. Alternative to the wheel unit being operatively coupled to various sensors, actuator(s) and system(s) discussed above; at least some of the various sensors, actuator(s) and system(s) discussed above may be comprised within the wheel unit 310.

According to an aspect, the wheel unit 310 is used to sense and control the motion of the gangway, especially the motion of the distal end 102*d*. When deployed towards an installation, a frictional force will exist between the wheel 315 and the landing surface on the installation due to the wheel 315 being pushed against the landing surface with a transversal force. When a torque is applied to the wheel 315, a lateral force will be exerted on the gangway. In case the wheel 315 is of the types mounted on a fork with ability to rotate around the x-axis as described above, or if the wheel 315 is of omni-wheel type, the force exerted on the gangway may comprise both lateral and vertical components.

According to an aspect, the gangway with additional actuators, such as actuator(s) for effecting slew movements 110 in the pedestal, and the wheel unit 310 is controllable by a gangway control system such that the control system can control both the slew movement 110 and the rotation 312 of the wheel 315 for controlling the overall horizontal movements of the gangway system. The slew movement may be controlled by a slew controller. The slew controller may be a separate controller or a part or module of the gangway control system. Similarly, the rotation of the wheel 315 may be controlled by a position controller. The position controller may be a separate controller or a part or module of the gangway control system. By overall horizontal movements, it is meant the movements along the y-axis. Accordingly, the gangway control system may control the slew movement 110 to effect a coarse adjustment, whereas the rotational movement 312 of the wheel 315 to effect a fine adjustment of the gangway position with respect to a reference point. Alternatively, or in addition, correction for slow movements may be effected by the control of the slew movement 110, whereas correction for fast movements may be effected by the rotational movement 312 of the wheel 315. From an environmental context, the slow movements or slow dynamics may be considered as those corresponding to a steady-state wind force, whereas the fast movements or fast dynamics may be considered as those corresponding to gusts in the wind force. The gangway can thus perform at least two control functions, first, for slew control, by measuring a lateral force acting between the distal end 102*d* and the landing site for generating a measured lateral force value. A signal dependent on the measured lateral force value is fed to the slew controller for minimizing the lateral force at the distal end 102*d*. By doing so, the amount of undesired lateral force acting on the passageway may be at least substantially reduced. The undesired lateral force can be generated, for example, due to winds or other environmental factors. In the second function, the wheel 315 may be rotated, for example, by the position controller, for positioning the distal end 102*d* at the desired position. Accordingly, the slew controller and the wheel controller collaborate to position the distal end 102*d* substantially close to the desired location.

According to another aspect, the wheel unit 310 may comprise a wheel unit controller rather than the wheel unit 310 being directly handled by the gangway control system. The gangway control system may then work together with the wheel unit controller to realize at least some of the functions explained above. The wheel unit controller may be a separate controller or a module within the gangway control system.

According to another aspect, the wheel unit 310 is used to measure the torque on the wheel 315, for example, by using a force or torque sensor. The measurement may be continuous or intermittent. When the wheel 315 is not being driven by an actuator, the torque on the wheel 315 is indicative of the lateral force acting between the installation and the distal end 102*d*. The wheel torque may thus be used for implementing the slew control as described above, for example, by using the wheel torque as, or to generate, a signal dependent on the measured lateral force value to be fed to the slew controller. In cases where the wheel 315 is driven by an actuator, a torque value indicative of the lateral force may be calculated by subtracting the force or torque applied by the actuator for driving the wheel 315 from the overall torque measured at the wheel 315. Accordingly, it is possible to extract the lateral force value for driven and not driven applications. Furthermore, for performing such calculations, a model of the system may be used.

Alternatively or in addition, the wheel unit 310 also the measures the position of the wheel 315. When the gangway is deployed and the wheel 315 is in contact with the landing surface on the installation with a pre-determined force, the wheel controller may be used to drive the wheel 315 such that the distal end 102*d* aligns to a desired position on the landing surface. Said driving of the distal end 102*d* may either be right after deployment of the gangway to the installation, or even be in real-time, to counteract the external forces. The examples of the external forces have been given earlier, which may be marine activity, winds or other environmental phenomena. Accordingly, the operational window of the gangway operation may be increased, and the scenarios with need for reconnecting to position the gangway may be minimized. Alternatively, if the wheel unit 310 does not have a dedicated wheel controller, said driving may be done by the gangway controller or another control system. The torque sensor may be a separate sensor, or it could be integrated within the actuator 320 or motor for driving the wheel 310. As explained previously, environment dependent forces, such as wind force, are substantially compensated by driving the slew actuator (e.g., driven by the slew controller), where the wheel 310 may be used as a lateral force sensor. This may at least substantially reduce the probability of a slip condition.

By "the scenarios with need for reconnecting" mentioned above, it is meant unexpected slip conditions. For any unexpected slip conditions, as an additional safety measure, if a slip has indeed occurred, for example, by a strong wind gust or such, and where such a slip condition may have moved the distal end 102*d* to an undesired position, the position control is used to reposition the distal end 102*d* back to the desired position. A secondary position sensor or measurement may be used to assist for such repositioning.

FIGS. 4A-B show another view of a gangway 440 with a rotational end effector. For simplicity, not all degrees of freedom are visible in FIGS. 4A and B, for example, heave movement 130 is not shown in FIGS. 4A and B for simplicity, but a skilled person will understand that such and other features not shown in FIGS. 4A-B may be present also in the example discussed further on.

The rotational end effector has been realized as a wheel unit 310. In a top-view of the gangway 440 shown in FIG. 4A, the wheel unit 310, more specifically a wheel 315 is shown in contact with an installation or receiving structure 400 at a point 402 on the landing surface 401 of the installation 400. In this example, the point 402 is a desired target point, i.e., the distal end 102*d* of the gangway 440 has been aligned at the position desired for the transfer of personnel or goods using the gangway 440. Once the wheel 315, or especially the distal end 102*d* of the gangway 440 has reached a desired position with respect to the installation 400, the wheel may be locked into position such that the tip or distal end 102*d* is held substantially close with respect to the desired position or a reference point usually on the landing site or installation 400. By the wheel 315 being locked into position, it is meant that the wheel is prevented from further rotation as long as the distal end 102*d* remains within predetermined limits of the desired position on the installation 400. Alternatively position of the distal end 102*d* may be measured for by a sensor, such as a rotation/position sensor located in the wheel unit 315 and/or as a secondary position sensor 416, to generate a distal end position signal, and if the distal end position signal value crosses certain limits, indicating that the distal end 102*d* has drifted by a certain distance from the desired position, the distal end 102*d* is then actuated back at or close to the desired position using the slew actuator and/or a wheel unit actuator 320. When the wheel is locked down at or substantially close to the desired location 402, the distal end 102*d* is retained in position due to frictional force between the landing surface 401, at the point where the wheel 315 is in contact with the surface 401 of the installation 400.

In FIGS. 4A-B, thus it would be the frictional force between the landing point 402 and the portion of the wheel 315 which is in contact with the landing point 402, which will form a frictional coupling, as in the Bumper principle explained earlier. While in the process of deploying the gangway 440, i.e., bringing the wheel at or close to the landing point 402, the wheel may first contact the installation surface 401 anywhere close to the landing point 402, and if not sufficiently close to the desired landing point 402, the wheel 315 may be driven by rotation along the rotational axis 311 to move the distal end 102*d* along the y-axis such that the wheel 315 aligns sufficiently close with respect to the desired landing point 402. In order to do so, the wheel 315 should be in contact with the installation surface 401. When the wheel 315 is not in contact with the surface 401, the adjustment along the y-axis may for example be done using the slew movement 110 of the pedestal 105 by using another actuator that drives the pedestal 105 relative to the base 406 along the slew axis 103, usually done by the slew actuator. According to an aspect, the gangway may detect a contact of the wheel 315 with an installation by measuring a transversal force by a force sensor, i.e., measuring the presence of a force by which the wheel 315 is being pushed against the installation 400. When there is no contact between the gangway distal end 102*d* and the installation, there will be no force of reaction exerted on the gangway 440. When the gangway 440 has been deployed and the wheel 315 is in contact with the surface 401, the wheel 315 and thus the gangway will experience an equal and opposite force (reactive force) which may be measured by a force sensor either placed within the wheel unit 310 and/or even at another appropriate location in the gangway 440.

The wheel may be driven by an actuator 320 such as a motor operatively coupled to the wheel 315 through a coupling system 325. The coupling system 325 that is shown realized in this example is a belt or chain type system. Alternatively, the coupling system could have been any of the other types as explained earlier. At the point 402 at which the wheel 315 is in contact with the landing surface 401 of the receiving structure or installation 400, may be termed the tip of the gangway. Only a small portion of the receiving structure 400 is shown, just as an example, with no specific limitation on the shape of the installation. As can be understood from the earlier discussion, the tip is at the distal end 102*d* of the gangway 440. The contact point 402, in practical cases will be a contact area due to resilient nature of at least the outer surface of the wheel and due to a transversal force applied to force the wheel 315 towards the contact point or area 402. Thus is practical cases there will be some deformation or flattening of at least some of the resilient portion of the wheel 315 along the installation surface 401, due to which the contact point 402 may actually be a contact area. However, for ease of discussions, the contact area, may be considered as a contact point 402 herein without affecting the scope or generality of the invention. At the contact point 402, a lateral force 418 is shown acting between the surface 401 of the installation and the wheel 315. The direction of the lateral force 418 is shown purely for illustrative purposes in FIG. 3. In reality, the direction and magnitude of any forces acting will depend upon operating and environmental conditions. The lateral force 418 may represent the frictional force between the wheel 315 and the contact point 402. On the top-side 405 of the gangway 440, a lip 403 or guard plate is installed, for example for safety purposes. The lip 403 is used for step-less transfer of goods and personnel, and to prevent any personnel or cargo traversing the gangway from coming in contact with the wheel unit 310.

According to another aspect, the secondary position sensor 416 is used for aligning the distal end 102*d* of the gangway 440 with respect to a reference point. The secondary position sensor 416 may be a camera providing a 2D or 3D image of the target or any other kind of position tracking sensor. According to another aspect, the secondary position sensor 416 may track the position by using a pre-determined pattern 417 attached close to the landing area such that the wheel 315 may be aligned at or substantially close to a desired point 402 on the installation 400. Alternatively, when the secondary position sensor 416 is a camera, the camera may generate its own reference pattern, for example, by taking a picture of at least a portion of the installation 400, and then using the picture to align the wheel 315 to the target point 402. Based upon a database of pictures of various installations and desired landing points, the camera may take real-time pictures to automatically control the deployment of the gangway to an installation. According to another aspect, the secondary position sensor 416 may be a stereoscopic sensor providing three-dimensional information for the target. For example, if the secondary position sensor 416 is a camera, the camera may be a stereoscopic camera to provide three-dimensional target information. A stereoscopic camera can be used to provide a target less image acquisition. Target less image acquisition meaning that no predefined information may be needed regarding the landing structure to be able to deploy the gangway.

An example of the landing process using a camera as a secondary position sensor is illustrated in FIG. 4C. When approaching an installation the vessel may use a DP system for positioning the vessel towards the installation. The gangway system may use attitude and position sensors, Motion Reference Unit ("MRU") and Global Positioning System ("GPS") 490 for controlling the ship position and a lever arm 495 relative to a global position. The lever arm 495 is a three-dimensional distance from the vessel motion center or sensor motion center to the gangway base such that rotation*arm=displacement. Getting closer however, the system may switch 455 to utilize the camera 416. The camera may be positioned on the gangway as illustrated in the drawings, but may also be placed in other locations as long as it is capable of measuring the relative position between the gangway end and the target point on the structure to which it is to be connected.

When the camera 416 takes over, the camera 416 detects the position of the target point 402, which then represents the global position reference. The camera provides the data to a forward kinetic unit 450, which also, preferably, received information about the actuator and joints controlling the gangway movement.

Based on the position of the base P_B and target point P_ref the necessary movement is found P_B_Ref from the base to the reference point on the target, and in an inverse kinematic unit 460 the joint coordinates q_Ref necessary to reach the target is calculated. This is translated 465 into control signals a_Ref for the actuator 470 which moves the joints 475 into correct positions. As stated above the status and position of the actuator a and joints q may be measured by suitable sensors or actuator drivers and transmitted 480 back into the forward kinetics unit 450. Depending on the camera capabilities, at least some of these data may alternatively be retrieved by analyzing the images obtained by the camera 416.

This way the embodiment of the invention incorporating a camera based reference system for moving the gangway the system may be fully automatic when landing a gangway on an offshore wind turbine or similar structures.

After the gangway 440 has been deployed, the secondary position sensor 416 may also be used to detect a slip or drift in the wheel 315 with respect to the desired landing point 402. Such a drift or slip may be as a result of the disturbances caused by the environmental conditions. Other variations of the secondary position sensor 416 may be, ultrasonic sensor, reflective sensor using laser or other light source, or the secondary position sensor 416 may even be a secondary wheel. Alternatively or in addition, the control of deployment may be done or assisted by an operator of the gangway 440. A skilled person will understand that a use of the secondary position sensor 416 and/or the pattern 417 is option with respect to the rest of the functionality explained in FIG. 4 and other variations of the present teachings.

Without a secondary position sensor 416, a position sensor in the wheel unit may be used to detect a drift. Such a position sensor may measure a rotational position representative of the rotation of the wheel 315.

Now referring to FIG. 4B, which shows a side-view of the gangway 440, where a representation of the transversal force 408 by which the wheel 315 is pushed towards the receiving structure 400 is also shown. More specifically, the force 408 is shown as a reactive force in response to the transversal force exerted by the gangway on the installation 400 at the contact point 402. A transversal force actuator 410 is also shown. The transversal force actuator 410 is used to extort the transversal force by transversal movement 150. The transversal actuator 410 may for example be a prismatic joint or other types as explained earlier in this disclosure. According to an aspect, the transversal force actuator 410 also comprises a force sensor for measuring the transversal force 408 and by using that the presence of a contact of the wheel 315 with the surface 401 of the installation 400. The actuator or motor 320 may have an inbuilt torque sensor, or the wheel unit 310 may have a separate torque sensor. Also in FIG. 4B, the pedestal 105 is shown mounted on a gangway base 406. One or more separate actuators (not shown in FIG. 4) may be used to effect slew movements 110 of the pedestal 105, along the slew axis 103, relative to the base 406. Luffing axis 301 is also shown, along which luffing movements 140 are effected. Luffing movements may require at least one separate actuator (not shown in FIG. 4).

Various actuators for effecting various movements in the gangway 440 are controlled either directly or indirectly by a gangway control system. The gangway control system will also receive a plurality of sensor inputs. Such sensor inputs may be from position sensors, force sensors, velocity sensors, associated with at least some of the various degrees of freedom in the gangway 440.

According to another aspect, the actuator 320 uses feedback control. The feedback control may include one or more operational modes. In a first operational mode, the actuator 320 will run with torque control to limit the possibility of slipping. In addition, another feedback from a secondary position sensor may be used to position the tip at the desired landing point. In addition to the feedback control, the control system, as separate controller or integrated, may include a cascade controller for the slew actuator and the wheel actuator for controlling either one or any of the following related to the slew actuator and the end effector respectively: position, velocity, force and torque. In such a control structure, the slew control loop slew may control torque, with feedback from the wheel unit. Whereas the wheel actuator controls speed and position of the distal end.

According to an aspect, the wheel unit 310 also comprises a locking device for preventing an undesired rotation of the wheel 310 along the rotational axis 311. The locking device may be a brake, for example, a mechanical brake, or an electrical brake, or their combinations. The locking device may act either on the wheel 315, or the coupling means 325, or the actuator 320, or even their combinations. According to another aspect, the locking device may be integrated in the actuator 320. When using a gearbox, drivetrain or gear train type coupling system 325, depending upon the conversion ratio, such locking means may even be redundant. For example due to high conversion ratio between the actuator 320 and the wheel 315, it might only be possible to induce rotations in the wheel 315 by rotating the actuator 320, and not the other way around. Alternatively, the locking device may be a ratchet type locking unit within the gearbox or gear train.

When the wheel 315 is in contact and locked in at the desired contact point 402, as long as the lateral force 418 acting at the contact point 402 of the wheel 315 does not exceed the frictional force, the wheel 315 and hence the distal end 102*d* will be retained in the desired position. A lateral force greater than the frictional force will lead to an acceleration of the gangway 440 in the slew direction 110. The frictional force may be increased, for example, by increasing the transversal force 408.

Based upon how the above-mentioned teachings are configured, the following operational cases may be used, Non-Driven Wheel:

The wheel 315 is not driven by the actuator 320, i.e., the actuator 320 is either absent or is not used. The wheel unit 310 may still comprise at least one sensor, for example a position sensor for measuring the rotational position of the wheel. In such a case, the slew movement 110 generated by a slew actuator may used to position the gangway towards the desired point 401 on the installation 400. The slew actuator may, for example, be placed in or close to the gangway base 406. The slew actuator rotates the pedestal 105 relative to the gangway base 406. A condition of contact of the wheel with the surface 401 of the installation 400 is detected by using a force sensor measuring the transversal force 408. The transversal force 408 may be adjusted to have sufficient frictional coupling between the wheel 315 and the surface 401. The wheel 315 then rolls on the surface 401 in y-direction due to slew movements 110 by the slew actuator until the wheel 315 is sufficiently close to the desired contact point 402. As understood, for aligning the gangway, rather than measuring the position of the wheel with respect to the desired contact point 402, the position of the distal end 102*d* with respect to a corresponding desired reference point may also be measured. The alignment may be done, for example, by using a secondary position sensor 416. Alternatively or in addition, the alignment may be done by or assisted by an operator. When alignment is satisfactory, the gangway may be locked into position, for example by locking the slew actuator. Alternatively or in addition, the wheel 315 may be locked in position, as explained earlier. As and if the wheel slips or drifts, the slew actuator is activated to drive the distal end 102*d* back into position. Provided that the transversal force maintains contact of the wheel 315 with the surface 401, the wheel 315 will then roll back towards the desired landing point 402 due to slew movements 110 generated by the slew actuator. The gangway control system can additionally control the various actuators of the gangway 440 for compensating the environmental disturbances such that the gangway remains substantially stationary with respect to the installation 400. An advantage of such an approach can be that the gangway 440 always remains in contact with the installation, and the control system is able to manipulate at least the movement of the gangway 440 along the y-axis even when the gangway is in contact with the installation 400.

Driven Wheel:

In this case, unlike the non-driven case, the wheel 315 can also be driven by the actuator 320. In such a case, for example, the slew actuator may be used to do a coarse alignment of the distal end towards a desired landing site or a reference point. The wheel 315 is then landed on the surface 401 of the installation. A contact is detected by measuring the transversal force 408, the wheel 315 is then driven using the actuator 320 for a fine alignment of the wheel with the desired landing point 402. As understood, for aligning the gangway, rather than measuring the position of the wheel with respect to the desired contact point 402, the position of the distal end 102*d* with respect to a corresponding desired reference point may also be measured. The alignment may be done, for example, by using a secondary position sensor 416. Alternatively or in addition, the alignment may be done by or assisted by an operator. When alignment is satisfactory, the gangway may be locked into position, for example by locking the wheel unit actuator 320. Alternatively or in addition, the wheel 315 may be locked in position, as explained earlier. As and if the wheel slips or drifts, the wheel unit actuator 320 is activated to drive the distal end 102*d* back into position. Provided that the transversal force maintains contact of the wheel 315 with the surface 401, the wheel 315 will then roll back towards the desired landing point 402 due to rotational movement 312 generated by the wheel unit actuator 320. The gangway control system can additionally control the various actuators of the gangway 440, including the wheel unit actuator 320, for compensating the environmental disturbances such that the gangway remains substantially stationary with respect to the installation 400. An advantage of such an approach can be that at least some of the disturbances are compensated using the wheel actuator 320, which is a relatively smaller system and typically faster to react as compared to the case where slew actuator and the gangway 440 have to be moved to compensate the disturbances. The compensation using the wheel unit actuator 320 may have a significantly smaller time constant as compared to that of the non-driven case, may enable the compensation of faster disturbances as well as better stability of a closed-loop system. Alternatively or in addition, the wheel unit actuator 320 will usually experience different dynamics as compared to what the slew actuator will experience because the wheel unit actuator 320 is placed closer to the point (i.e., the distal end 102*d*) being positioned or controlled. As will be appreciated, in the gangway system aspect, the slew actuator based control or slew dynamics may be characterized as a non-minimum phase system, at least because of the bending of the passageway. Non-minimum phase systems have physical limitations for achievable performance and stability. According to the present teachings, an end effector and/or a measuring unit located in close proximity to the landing site, brings the gangway system to a minimum phase system. Hence, a faster feedback control dynamics may be achieved. By effecting position control of the distal end 102*d* using the wheel unit 310 unwanted dynamics of the system such as flexing of the gangway arm 102 may be reduced or eliminated from the transfer function of the system. Such unwanted dynamics would normally appear in the gangway system transfer function, for example if the movements are effected using the slew actuator rather than the wheel unit actuator. Similarly, at least some distal end measurements, such as measuring drift of the distal end, when done with a sensor located closer to the distal end 102*d* will have advantage as compared to measurements done at the gangway pedestal or base.

It will be appreciated that each of the non-driven wheel mode and the driven wheel mode discussed above is novel and inventive in its own right, besides a combination of these modes being novel and inventive.

According to another aspect, the gangway control system may allocate compensation between the slew actuator and the wheel actuator 320, based for example on slow and fast disturbances respectively. As also discussed previously, from an environmental context, the slow disturbances or slow dynamics may be considered as those corresponding to a steady-state wind force, whereas the fast disturbances or fast dynamics may be considered as those corresponding to gusts in the wind force. According to another aspect, the when unit 310 may also comprise a wheel unit controller. The gangway control system may then communicate and if required, control the wheel 315 through the wheel unit controller.

According to another aspect, the slew controller goes from active mode (i.e., driven mode) to a passive mode (i.e., switched-off mode) as soon as a contact between the wheel 315 and the surface 401 is detected. In such a case, the control of the distal end 102*d* movement along the y-axis is done only using the wheel actuator 320.

Irrespective of the driven or non-driven case above, it will be appreciated that the proposed teachings in general can allow for achieving an accurate alignment without the need for removing and reconnecting the gangway distal end 102*d* from the installation 400, should it be a case that in a first try the gangway did not contact the installation 400 close to the desired position. Furthermore, the non-driven case may be an operational mode of the gangway system that also can operate in the driven case.

From the preceding discussion, the present teachings can thus be used for:

A. Reducing a Risk of the Gangway Sliding Off the Installation:

This can be done, for example, by measuring the acting transversal force 408, and using a slew controller driving the slew actuator and hence rotating the pedestal 105 with respect to the gangway base 406 to minimize the lateral force 418 acting at the distal end or tip 102*d*.

Avoiding a slip condition by using the wheel unit 310 in an anti-slip mode. This can for example be done by limiting the wheel torque. One way to estimate maximum wheel torque is calculate the maximum torque for a given frictional force. The system can then limit the torque below this value to minimize the chances for a slip condition when the wheel 315 is driven. According to another aspect, this functionality may also be used as an active damping mode instead of the locking in of the wheel 315 discussed before. The wheel 315 is thus not locked, but configured as an active damper. The wheel 315 is thus allowed to move and but motion will be dampened. This mode may be useful in conditions where large variations in the lateral force 418 are expected such that a slip condition are likely. By configuring the wheel unit 310 in an active damping mode, the likelihood of slip can be at least substantially reduced. Even though the wheel is allowed to drift, it is subsequently rolled back at or close to the desired position 402. The main objective of the anti-slip mode is to prevent sudden loss of contact due to slip caused by large lateral forces, and rather let the wheel drift as a result of such large lateral forces and subsequently correct the drift. By doing to, stability and safety of the gangway may be enhanced.

B. Increasing Safety:

By estimating a friction force, calculated based upon the friction between the wheel 315 and the landing surface 401 as a first estimate, for example by using the measured Transversal force. Alternatively, the wheel unit 310 may create an exploratory contact with the landing surface and measure the transversal force 408 and the lateral force 418 at which the wheel 315 starts slipping on the surface 401. Said lateral force may be induced for example by the slew actuator. Based upon said exploratory contact, a value of the frictional coefficient may be estimated. In either case, whether the frictional force is calculated using a pre-determined frictional coefficient or being measured by an exploratory contact, the system can indicate if a slide-off or slip is likely for prevailing conditions.

In case a slide-off or slip has occurred. The system detects such a condition, for example by using a secondary position sensor 416 as discussed previously.

C. A safer and easier method to correct the distal end or tip 102*d* position whilst maintaining a transversal force towards the platform.

If the distal end 102*d* of the gangway 440 did not land at or close to a desired landing position, the distal end 102*d* may not be required to disconnect from the installation 400 and reconnect to adjust the tip 102*d* position.

A control of the distal end 102*d* is achieved by rotation of the end effector wheel 315, while maintaining a transversal force pushing the distal end 102*d* towards a landing structure 400.

With a conventional static rubber bumper stiction and/or friction forces will prevent such a functionality with a slew actuator.

According to the teachings presented herein, a typical operational scenario in such case could be:

1. Steering a vessel using a Dynamic Positioning ("DP") system to approach a landing structure or installation 400 where the gangway 440 is to be deployed.
2. When the vessel is within a pre-determined distance of the installation 400, the gangway control system controls the various degrees of freedom of the gangway to position the gangway so as to prepare for contact with the installation 400.
3. The wheel 315 contacts the installation 400 at surface 401. The contact condition is detected using a transversal force sensor. To prevent that the gangway distal end movements effected by the when 315 result in unwanted torque/force on the gangway arm 102, the gangway control system sets the slew actuator either in a passive mode, or in a slew assisted mode. The passive mode can either be,
   a. A full passive mode in which the slew movement is not being driven by the slew actuator and hence the slew is moving essentially freely, or
   b. A headroom passive mode in which the slew controller opens up certain movement range or headroom for the wheel actuator to effect distal end movements. The certain movement range opened upped by the slew controller is such that the wheel actuator can effect movements in the distal end 102*d* while avoiding unwanted toque in the gangway arm due to the wheel actuator effected movements conflicting with the slew actuator movements or torque.

In slew assisted mode, the slew actuator assists the wheel actuator in effecting the distal end movements. This may be achieved by the wheel controller collaborating with the slew controller. As discussed previously, the wheel controller and the slew controller may be sub-modules of the gangway controller.
4. If the distal end 102*d* is not at a desired position along the y-axis. The wheel 315 is rotated so as to bring the distal end 102*d* sufficiently close to the desired position. The desired position of the distal end 102*d* can corresponds, for example, to the wheel 315 being at or sufficiently close to the desired landing point 402, while being in contact with the surface 401.

The above scenario is similar to the driven wheel case discussed previously. Alternatively to the slew actuator being in passive mode, the functionality similar to that of the non-driven case may be used, i.e., the slew controller or gangway controller is used to minimize the lateral force 418 on the wheel 315 by rotating the gangway using the slew actuator.

Thus, according to an aspect the gangway is operated in a coordinated control mode in which the slew actuator and the rotatable element actuator are configured to operate in a control mode in which said actuators coordinatively effect the movement in the distal end. The coordinated control mode may be any of the: passive mode, headroom passive mode, and assisted mode as discussed above.

FIG. 5 shows a flowchart 500 for transversal force control ("TFC"). TFC as shown in the flowchart 500 may be implemented in the gangway controller, or it may be implemented as a dedicated controller or alternatively as a part or module of any other controller related to the gangway system. Upon start or initialization 501, as a first step 502 the TFC may start reading/acquiring a first torque or force signal from the transversal force actuator 410. The "torque or force" signal means that whether a torque or a force is measured is dependent upon the type of actuator, i.e., rotary or linear. In any case, the first torque or force signal is indicative of the transversal force by which the wheel 315 is being pushed against the installation 400. To further clarify, from FIG. 4B it can be seen that the transversal force (see the corresponding reaction force component 408) is acting along the x-axis. In a subsequent step 503, the TFC checks if a value of the transversal force, measured from the first torque or force signal, is equal to a desired transversal force value. The desired transversal force value may be set by the operator alternatively or in addition the desired transversal force value may be computed by the gangway control system, e.g., based upon either one or any of the following: frictional properties of the surface of the wheel 315, frictional properties of the surface of the landing site, environmental parameters such as temperature, humidity, marine activity, or it can be a transversal force value picked from a database of reliable force values, generated by a machine learning algorithm or such. If the measured transversal force value is substantially equal to the desired transversal force value, the controller moves further to step 505. If the measured transversal force value is not equal to the desired transversal force value, then the controller moves to step 504 and drives the transversal force actuator 410 to make adjustments or corrections to the transversal force actuator 410 such and until the measured transversal force value becomes substantially equal to the desired transversal force value. Said adjustments or corrections may for example be driving the distal end 102*d* towards or away from the landing site 400 while comparing the measured transversal force value with the desired transversal force value, the direction of correction depending upon how the measured transversal force value compares with the desired transversal force value. In step 505, the controller checks if the TFC should be terminated. If yes, the TFC is terminated. If not, the TFC controller starts again at step 502. The termination may be initiated by the operator or the gangway control system, for example, when the system shall disconnect from the installation.

FIG. 6 shows a flowchart 600 for lateral force control ("LFC"). LFC as shown in the flowchart 600 may be implemented in the gangway controller, or it may be implemented as a dedicated controller or alternatively as a part of any other controller related to the gangway system. Upon start or initialization 601, as a first step 602 the LFC may start reading a second torque or force signal from the wheel unit actuator 320 The "torque or force" signal means that whether a torque or a force is measured is dependent upon the type of actuator, i.e., rotary or linear. In any case, the second torque or force signal is indicative of the lateral force 418 acting on the wheel 310. To further clarify, from FIG. 4A it can be seen that the lateral force is shown acting along the y-axis. In a subsequent step 603, the LFC checks if a value of the lateral force, measured from the second torque or force signal, is equal to a desired lateral force value. The desired lateral force value may be set by the operator or by the gangway control system, e.g., based upon either one or any of the following: frictional properties of the surface of the wheel 315, frictional properties of the surface of the landing site, environmental parameters such as temperature, humidity, marine activity, or it can be a lateral force value picked from a database of reliable force values, generated by a machine learning algorithm or such. The desired lateral force value is typically selected to be zero or essentially zero. As discussed previously, the slew movement is controlled such that the lateral force on the tip is essentially zero. By minimizing the lateral force, the probability of sliding can be minimized. A skilled person will appreciate that any other value of lateral force may also be selected, if for example a particular bias in a given direction may be desirable.

If the lateral force value is substantially equal to the desired lateral force value, the controller moves further to step 605. If the lateral force value is not equal to the desired lateral force value, then the controller moves to step 604 and drives the slew actuator to make adjustments or corrections to the slew actuator such that a slew movement is effected, while comparing resulting measured lateral force values with the desired lateral force value, until the measured lateral force becomes substantially equal to the desired lateral force value. The controller hence tries to minimize the difference between the measured lateral force value and the desired lateral force value. In step 605, the controller checks if the LFC should be terminated. If yes, the LFC is terminated. If not, the LFC starts again at step 602.

FIG. 7 shows a flowchart 700 for Tip position control ("TPC"). TPC as shown in the flowchart 700 may be implemented in the gangway controller, or it may be implemented as a dedicated controller or alternatively as a part of any other controller related to the gangway system. Upon start or initialization 701, as a first step 702 the TPC may receive a position signal indicative of the position of the distal end 102*d*. The position signal may be received from a primary position sensor and/or from a secondary position sensor. The secondary position sensor is required for the anti-slip functionality as explained before. The position signal, may thus be a plurality of signals in case both primary and secondary position sensors are available. In a subsequent step 703, the TPC checks if a measured tip position value is substantially equal to a desired position value. The desired position value may be set by the operator alternatively or in addition the desired position value may be computed by the gangway control system, e.g., based upon either one or any of the following: frictional properties of the surface of the wheel 315, frictional properties of the surface of the landing site, environmental parameters such as temperature, humidity, marine activity, or it can be a position value picked from a database of reliable position values, generated by a machine learning algorithm or such. If the measured tip position value is substantially equal to the desired position value, the controller moves further to step 705. If the measured tip position value is not equal to the desired position value, then the controller moves to step 704 and drives the wheel unit actuator 320 to make adjustments or corrections to the wheel unit actuator 320 such that the distal end 102*d* is moved resulting in the measured tip position value becoming substantially equal to the desired position value. In step 605, the controller checks if the TPC should be terminated. If yes, the TPC is terminated. If not, the TPC starts again at step 702.

Figure 9B:
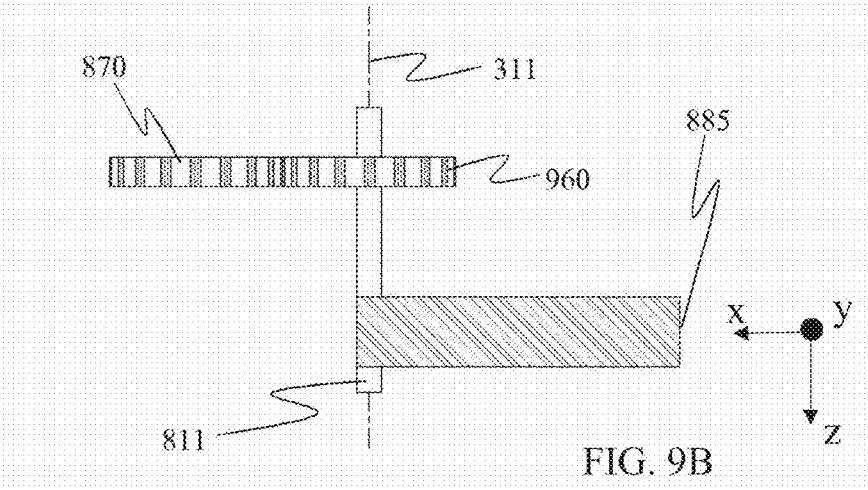

Now certain non-limiting examples related to the end-effector unit will be discussed. The non-limited examples may be combined with any of the variations of the present teachings. In previous examples the rotatable element was shown as a wheel 315. As will be appreciated, a diameter of the wheel 315 can be selected based upon application and within the constraints of what is practically and economically feasible. In some embodiments, the diameter of the wheel is between 0.01 m-10 m. In other embodiments, the wheel diameter is between 0.1 m and 1 m. In some embodiments, the wheel diameter is between 0.3 m and 0.7 m. In certain embodiments, the wheel diameter within the range of automotive wheel sizes is preferable. In some embodiments, an automotive wheel is used as a wheel of the end effector unit. FIG. 8 shows an example of a rotatable element 815 that is a semi-wheel. The semi-wheel or semi-round rotatable element 815 has an outer surface 885 a portion of which is adapted to be in contact with an installation. The dimensions of the semi-wheel rotatable element 815 are decided based upon the application. As it will be understood, the dimensions such as radius 855, and sector angle 865 of the rotatable element 815 will depend upon the size of the installation, maximum angle by which the rotatable element 815 needs to rotate. A skilled person will also understand that larger the radius 855 the longer distance the distal end 102*d* of the gangway will traverse along the installation surface for per degree rotation of the rotatable element 815. The rotatable element 815 is rotatable around an axle 811. The rotatable element is shown operatively coupled to a gear 870 through a gear section 860. The gear section may be a part of the rotatable element 815. The gear 870 may be driven by an actuator such that a rotation 812 of the gear 870 results in a corresponding rotation 312 in the rotatable element 815. Alternatively or in addition, for example, for the non-driven wheel case, the gear 870 is operatively coupled to a sensor, such as position sensor and/or a rotation sensor, such that a rotation of the rotatable element 815 is measurable by measuring the rotation/displacement of the gear 870. The rotatable element 815 and/or the gear may further be operatively coupled to at least one of other kinds of sensors such as velocity, force, torque, acceleration sensors. The gear 870 may either be mounted in the same plane as the rotatable element 815 as shown in FIG. 8, or it may be offset to another location on the shaft or axle 811 of the rotatable element 815. This is shown in FIGS. 9A and 9B with a slightly different rotatable element 815. The rotatable element 815 in FIG. 9A is shown with a larger sector angle 865. In a further difference, instead of the gear section 860 being is a part of the rotatable element 815, a shaft gear 960 is provided. The shaft gear 960 is connected to the rotatable element 815 through the shaft 815. FIG. 9A is a perspective view and FIG. 9B is a side view of the rotatable arrangement of FIG. 9A. As will be appreciated, instead of a gear-based coupling, as shown in FIGS. 8 and 9, the rotatable element may be coupled using other kinds of couplings as discussed previously in this disclosure. Gear-based coupling is shown just as an example to illustrate that the rotatable element may be half-round rather than being a whole wheel. All values of the sector angle 865 lie within the ambit of the present teachings.

With reference to FIG. 10, according to another aspect, the outer surface 885 of the rotatable element 315, shown here also as a wheel, may even be realized using a belt 1085. The rotatable element may hence be realized as a wheel-belt system. Rotation 312 of the wheel 315 relatively corresponds to a movement 1012 in the belt 1085. The rotation 312 and the belt movement 1012 can be both bidirectional according to requirement. Preferably, the belt 1085 is made of resilient material such as rubber or silicone or their combinations. The belt could be made of the similar materials as found in tires used in automobiles or aircrafts. Details on composition are not discussed herein, as they are not essential to the disclosure. The belt 1085 may have a plurality of indentations 1075 on its surface facing towards the rotatable element 315, and the rotatable element 315 may have a corresponding plurality of projections 1076 that can operatively engage with the indentations 1075 for improving the contact between the rotatable element 315 and the belt 1085. As it will be appreciated, such corresponding indentations and projections may prevent the rotatable element 315 from slipping from the belt 1085. As it will be appreciated, instead of the wheel 315 having projections and the belt 1085 having corresponding indentations, the wheel 315 may have indentations and the belt 1085 corresponding projections. However, the presence of such indentations and corresponding projections as shown is not essential to the belt based end effector as shown in FIG. 10. As long as the surface of the rotatable element 315 facing the belt has enough frictional contact with the surface of the belt 1085 facing the rotatable element 315, explicit projections and indentations may not be required.

Figure 11B:
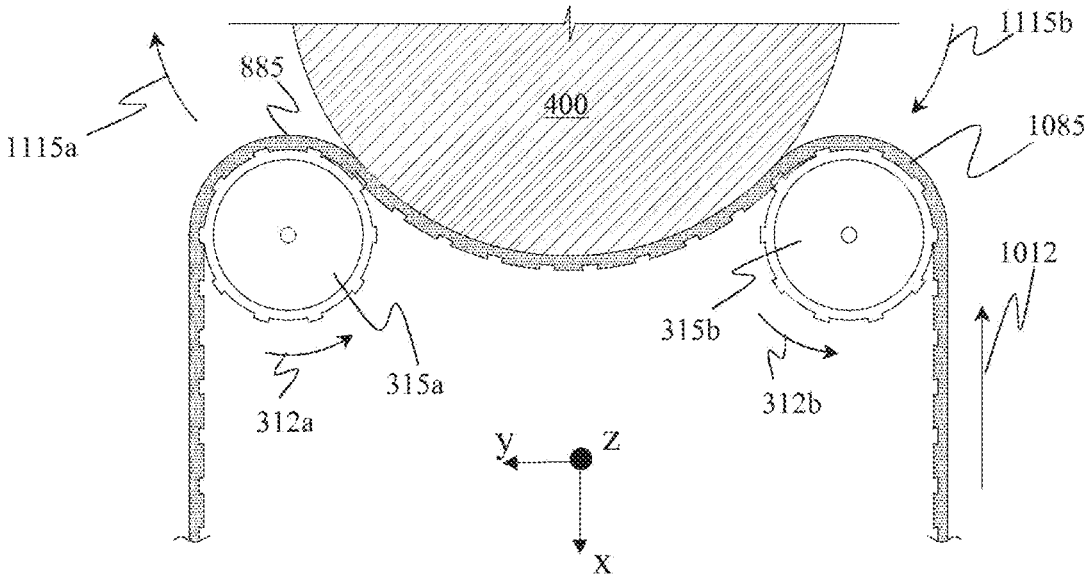

According to another aspect of the wheel-belt system, the rotatable element 315 may be a plurality of elements, or wheels. For example, as shown in FIGS. 11A and 11B where rotatable element 315 is realized with two wheels 315*a* and 315*b* that are spaced apart with a distance 1133 between their respective axes. The wheels 312 share a common belt 1085. A rotation 312*a* of the first wheel 315*a* relatively corresponds to a movement 1012 in the belt 1085 and to a rotation 312*b* of the second wheel 315*b*. The FIG. 11B, the distal end 102*d* of the gangway is shown in contact with the installation 400, just a section of which is visible in FIG. 11B. A portion of the outer surface 885 of the belt is in contact with the installation 400. The installation 400 as shown in FIG. 11B has a diameter that is shown almost equal to the wheel spacing 1133. Within the contact surface between the belt 1085 and the installation 400, the belt adapts to the shape of the installation. However as will be appreciated, the installation diameter can be smaller or even several orders larger than the spacing 1133, moreover the installation 400 need not essentially be cylindrical in profile. The shape and size of the installation is hence not limiting to the scope or generality of the invention. If the installation diameter or other corresponding dimension is much larger than the wheel spacing 1133, the contact surface between the will be relatively straight. An advantage of such configuration with two or more wheels and contact area spanning between these, as shown in FIG. 11, is that contact area between the installation and the distal end 102*d* is increased, hence increasing frictional area and reducing the chance of slipping between the installation and the distal end. Slipping was discussed earlier in this disclosure. Also shown in FIG. 11B is movement trajectory of the distal end 102*d* with respect to the installation 400, said movement shown as arrows 1115*a* and 1115*b* that represent the axial loci of the wheels 315*a* and 315*b* respectively as the belt movement 1012 progresses in the direction shown. Corresponding wheel movements are shown as arrows 312*a* and 312*b* respectively.

FIGS. 12A-C show some non-limiting examples of the profile of the belt 1085. According to another aspect, the belt 1085 may also have a plurality of projections 1285 on its outer surface 885. The outer surface 885 is the surface a given portion of which is in contact with an installation when the distal end is deployed against the installation. The projections 1285 may either be straight vertically as shown in FIG. 12A, or they may be slanted as shown in FIG. 12C, or they may have any other pattern such as zig-zag or other staggered patterns, for example as treads found on tires or on belts for snow-throwers and such. Alternatively or in addition, the outer surface may have indentations. According to another aspect, the installation surface where the distal end

102*d* is deployed, may comprise indentations and/or projections for operatively engaging with the corresponding projections and/or indentations on the outer surface 885 of the belt. The installation surface comprising indentations and/or projections extends also to the case when the rotatable element is a wheel without belt or a semi-wheel as discussed previously.

With reference to FIG. 13, according to yet another aspect, the rotatable element may even be rotatable in multiple dimensions, for example, spherical or essentially spherical shaped such as a ball 1315. At the distal end 102*d*, an area of the ball 1315 is exposed through an aperture 1352 in an enclosure 1355 that retains the ball 1315 in position. When the gangway with the ball end effector is deployed against an installation, a portion of the exposed area of the ball is in contact will the installation. The ball 1315 is rotatable within the enclosure 1355. The ball 1315 may be driven by a mechanism such as by two shafts, a first shaft 1311 for effecting horizontal movements in the distal end 120*d*, and a second shaft 1312 for effecting vertical movements in the distal end 102*d*, by rotating the ball 1315 when the distal end 102*d* is deployed against an installation. Alternatively, respective horizontal and vertical movements of the distal end may be resolved into rotations 1321 and 1322 of the respective shafts 1311 and 1312, the shafts being rotated due to rotation of the ball 1315. The latter case refers to a non-driven case of the end effector. Furthermore, a drift of the distal end 102*d* can be being measured by measuring the rotations of the shafts effected due to a rotation in the ball 1315.

It may be noted that an end effector with a type of arrangement as shown in FIG. 13 resembles a computer trackball or mouse mechanism.

At least the outer surface of the ball 1315 is resilient material such as discussed previously.

The shafts 1311 and 1322 are held in position by bearing posts 1376 or such fixing means. The shafts 1311 and 1312 have driving portions 1341 and 1342 for relatively translating movement of the respective shafts into a movement of the ball 1315. Each driving portion 1341 and 1341 is designed such that it essentially freely allows for the movement in the ball due to a rotation of the other shaft. The shafts may either be driven directly through their respective actuators, or the shafts may be coupled through coupling means 1381 and 1382 to their respective actuators. Alternatively or in addition, the coupling means may comprise at least one sensor.

As will be appreciated, a ball type end effector may allow effecting both horizontal and well as vertical movements, and a combination of those, of the distal end 102*d*. Accordingly, a vertical position of the distal end 102*d* may be adjusted without disconnecting the gangway from the installation.

According to another aspect, for effecting both horizontal and well as vertical movements and a combination of those, an omni-wheel is used as end effector. The omni-wheel is a wheel that is capable of effecting movements in a plurality of axes. The omni-wheel is not discussed further in this disclosure as the term will be known to the skilled person.

Figure 14B:
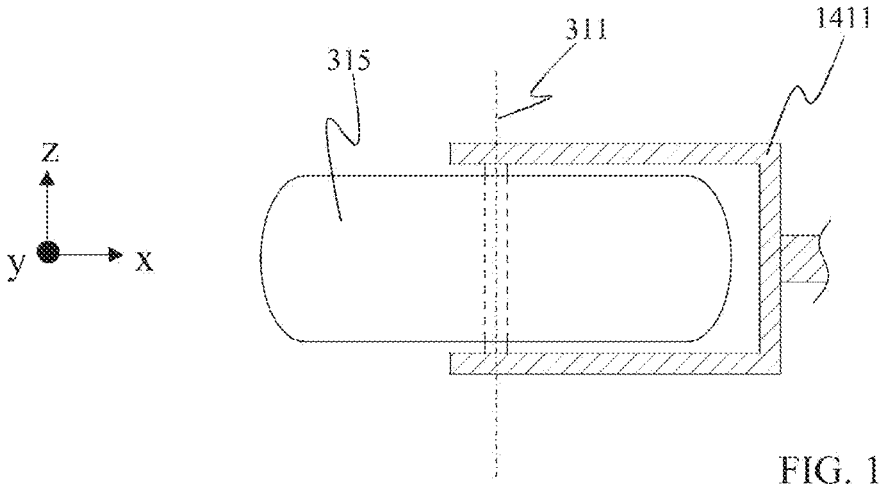

Vertical movements may also be effected in a wheel based end effector, which is discussed in the following. According to another aspect, the rotatable element can be mounted in a rotatable mechanism, the rotatable mechanism being capable of altering an angle between an axis of rotation of the rotatable element and the axis 103 of the pedestal or base of the gangway. With reference to FIGS. 14A and 14B, one way to alter an angle between an axis of rotation of the rotatable element and the axis 103 of the pedestal for achieving movements in more than one axis is to mount the wheel 315 in a rotatable mechanism that can itself be rotated. This is shown as a fork-wheel arrangement in FIGS. 14A and 14B with a wheel 315 mounted in a fork 1411. It will be appreciated that instead of a full-wheel as shown, any other kind of rotatable element may be mounted in a rotatable mechanism such as a fork.

In FIG. 15, which is a rear-view of the fork-wheel arrangement, various movements along y and z axes realized using a fork based wheel are shown. In (A), a rotational movement of the fork 1411 is shown. In (B), horizontal movements along the y axis is shown, In (C), combined movements along the y and z axes are shown with the fork rotated at an angle in the counter-clockwise direction when looking at the view shown in FIG. 15, whereas (D) shows combined movements along the y and z axes with the fork rotated at another angle in the clockwise direction when looking at the view shown in FIG. 15. As will be appreciated, other angles are possible even though not explicitly shown in the figure.

In FIG. 16, an example of a method for relocating the distal end 102*d* with a rotatable mechanism such as a fork mounted wheel, without disconnecting from the installation is shown. Point (L) represents an initial position where the distal end 102*d* has been deployed. It is required that the distal end 102*d* be relocated to a final position (R) without disconnecting the gangway from the installation. Initially, at point (L), the fork is rotated anti-clockwise to a given angle and the wheel 315 rotated such that the distal end 102*d* reaches a first intermediate position (M), then the fork 1411 is rotated clockwise to another given angle and the wheel 315 rotated such that the distal end 102*d* reaches a second intermediate position (N), then the fork 1411 is rotated anti-clockwise to another given angle and the wheel 315 rotated such that the distal end 102*d* reaches a third intermediate position (O), similarly, the process of rotating the fork 1411 and effecting rotation in the wheel 315 is repeated until the distal end 102*d* reached the desired final position (R). It will be appreciated that the various given angles and wheel rotations as discussed above will depend, for example, upon the maximum horizontal distance between each successive points within which the process must be restricted to. Another factor could be maximum resultant speed along the z-axis, and other safety or safe operation requirements.

To summarize, the present teachings relate to a gangway comprising a distal end on which an end effector unit is attached, the end effector unit having an outer surface at least a certain portion of which is adapted to be in contact with an installation, wherein a movement of a rotatable element in the end effector unit corresponds to a movement of the distal end with respect to a reference point on the installation when the end effector unit is in contact with the installation, the movement of the distal end being at least along one of the axes related to the installation.

Present teachings also relate to a gangway comprising a distal end on which an end effector unit is attached. The end effector is having an outer surface at least a certain portion of which is configured to be in contact with an installation. The end effector unit also comprises a sensor. A movement of a rotatable element in the end effector unit corresponds to a movement of the distal end with respect to a reference point on the installation when the end effector unit is in contact with the installation. The movement of the distal end is at least along one of the axes related to the installation. The sensor is configured to provide at least one output signal dependent upon the position of the distal end with respect to the reference point. The gangway is also operatively linked to an actuator. The actuator is configured to effect movement in the distal end for positioning the distal end at least substantially close to a desired location on the installation.

The gangway may be installed on a vessel or it may be installed on a fixed structure. The installation may either be a fixed structure offshore or on land, or the installation may be a floating vessel or structure.

According to an embodiment, the rotatable element is a wheel. In which case, the movement of the rotatable element is rotation of the wheel. According to another embodiment, the rotatable element is a semi-wheel. The wheel may even be an omni-wheel.

According to yet another embodiment, the rotatable element is essentially spherical, such as a ball. In which case, the movement of the rotatable element is a rotation of the spherical rotatable element.

According to an embodiment, at least one of the at least one output signal of the sensor is dependent upon to the movement of the rotatable element.

According to another embodiment, the rotatable element is mounted in a rotatable mechanism, said rotatable mechanism being adapted to alter an axis of rotation of the rotatable element with respect to an axis of the base of the gangway.

According to another embodiment, the rotatable element is a wheel-belt system. The wheel-belt system comprises at least one wheel operatively coupled to a belt. The belt forms at least some of the outer surface of the rotatable unit, a certain portion of which is adapted to be in contact with the installation. According to another embodiment, the wheel-belt system comprises a plurality of wheels.

According to another embodiment, the rotatable element is coupled to a force sensor, the force sensor being configured to measure a force with which the rotatable element is pushed against the installation. The force sensor is adapted to measure at least one force acting between the installation and the end effector unit. In other words, the force sensor is configured to output a force signal indicative of the force with which the rotatable element is pushed against the installation. It will be understood that the force signal may be an electrical output signal indicative of the force, and/or it may a non-electrical signal, depending upon the type of sensor used. It will be appreciated that non-electrical sensors also exist, further details of which is not pertinent to the scope or generality of this disclosure.

According to another embodiment, the rotatable element is coupled to a position sensor, the position sensor being configured to measure a position of the rotatable element with respect to a reference point. In other words, the position sensor is configured to output a position signal indicative of the position of the rotatable element with respect to a position reference point. Similarly, it will be understood that the position signal may be an electrical output signal indicative of the position, and/or it may a non-electrical signal, depending upon the type of sensor used.

According to another embodiment, the rotatable element is coupled to a velocity sensor, the velocity sensor being configured to measure a velocity related to a rotation of the rotatable element. In other words, the velocity sensor is configured to output a velocity signal indicative of the velocity related to the rotation of the rotatable element. Similarly, here also it will be understood that the velocity signal may be an electrical output signal indicative of the velocity, and/or it may a non-electrical signal, depending upon the type of sensor used.

The actuator may be a slew actuator of the gangway, and/or it may be an actuator controlled by the DP system. The actuator may even be one or more thruster or a propeller or similar actuators controlled by the DP system.

According to another embodiment, the end effector unit also comprises an actuator, or the actuator discussed above is a rotatable element actuator. When the end effector unit is in contact with the installation, the rotatable element actuator is configured to effect movement in the rotatable element for positioning the distal end at least substantially close to a desired location on the installation. The end effector unit may even comprise a plurality of actuators. The end effector unit may even be retracted from the distal end using at least one of the plurality of actuators.

The gangway may further comprise a slew actuator. The gangway may be configured to operate in a coordinated control mode in which the slew actuator and the rotatable element actuator are configured to operate in a control mode in which said actuators coordinatively effect the movement in the distal end. By coordinatively effecting the movement, it is meant one or more of the actuators operating: simultaneously, sequentially, or one of the actuators being disengaged thus offering minimum hindrance to the other actuator from effecting the movement.

The control mode can be a full passive mode as discussed previously. In the passive mode, the slew actuator is configured to disengage from driving the distal end. In this mode the slew actuator is also prevented from retaining or locking the distal end at a given position, hence offering minimum hindrance to the rotatable element actuator from effecting the movement.

The control mode may even be a headroom passive mode as discussed previously. In this mode, the slew actuator is configured to disengage between a predetermined movement range of the distal end. In other words, the slew actuator offers minimum hindrance to the rotatable element actuator from effecting the movement within a predetermined range of the movement of the distal end. This mode can be helpful in locking the distal end from further movement beyond one or more predetermined limits. This can be beneficial, e.g., for preventing the distal end from drifting beyond the limits within which the rotatable element actuator can effect the movement for aligning the distal end substantially close to the desired position.

The control mode may even be an assisted mode as discussed previously. In this mode the slew actuator is configured assist the rotatable element actuator for effecting the movement in the distal end.

The end effector unit is configured to be in contact with the installation with a predetermined transversal force. A controller or a control system is used to regulate the predetermined transversal force. The controller may be a separate controller, or end effector unit controller, or integrated with the gangway controller. Alternatively in cases where the gangway is mounted on a vessel, the whole vessel may be controlled by an integrated controller with respective controllers being sub-controllers or even software modules within the integrated controller. The predetermined transversal force is calculated based upon at least some of the system parameters including, any one or more parameters from: prevailing environmental conditions or factors, properties of the installation surface, and properties of the outer surface, etc.

A landing site on the installation may be selected based upon the at least one of the parameters related to the prevailing environmental conditions or factors. A desired location may be found where the influence of the prevailing environmental conditions on the vessel or the gangway is deemed to be minimal.

According to another embodiment, when the end effector unit is in contact with the installation, the slew controller of the gangway is configured to at least partially minimize a lateral force acting between the distal end and the installation. The slew controller is functionally or operably connected to the slew actuator.

In an embodiment, the end effector unit is operatively coupled to an anti-slip system. The anti-slip system comprises or is controlled by an anti-slip controller receiving input from at least one sensor. The anti-slip system is adapted to control at least one of the actuators in the end effector unit for bringing the distal end back essentially at the desired location. The controller and the anti-slip controller can be a common controller or they may be separate controllers.

According to yet another embodiment, the gangway further comprises a secondary position sensor. The secondary position sensor is preferably a camera. According to an embodiment, the anti-slip system is configured to receive at least one secondary position signal from the secondary position sensor. The anti-slip system is configured to bring the distal end back essentially at the desired location based upon at least one of the at least one secondary position signal.

According to an embodiment, the outer surface is at least partially composed of a resilient material. The resilient material may be a rubber or silicone or at least one of their compounds.

The end effector unit may also comprise an end effector unit controller. The end effector controller may be configured to coordinatively operate with a controller of the gangway. In some embodiments, at least one of the end effector unit controller and the gangway controller is configured to coordinatively operate with a dynamic positioning system of the vessel. In other words, the gangway, or the end effector unit, may also comprise an end effector unit controller. The end effector unit controller is operably or functionally connected to the rotatable element actuator for controlling the rotatable element actuator.

At least one of, the end effector controller, and the slew controller may be configured to coordinatively operate with the gangway controller. Furthermore, at least one of the end effector unit controller, the slew controller, and the gangway controller may be configured to coordinatively operate with the DP system.

The end effector unit may be operated in a driven mode, or it may be operated in a non-driven mode.

The present teachings also relate to a method for repositioning a gangway to a desired position on an installation or a target structure, the gangway comprising an end effector unit having an outer surface at least a certain portion of which is adapted to be in contact with the installation; the method comprising the steps of:

- Registering an initial landing position on the target structure around the time when a distal end of the gangway contacts with the installation or the target structure
- Comparing the initial landing position with the desired position and generating an initial error signal relative to the difference between the initial landing position and the desired position
- Effecting a movement in the gangway for minimizing the error signal without disconnecting the distal end from the installation.

According to another aspect, the method, additionally or alternatively, comprises the steps of:

- Measuring a position of the distal end while the distal end is in contact with the installation or the target structure
- Comparing the position with the desired position and generating an second error signal relative to the difference between the position and the desired position
- Effecting a movement in the gangway for minimizing the second error signal without disconnecting the distal end from the installation or the target structure.

Present teachings also relate to a method for repositioning a gangway distal end substantially close to a desired position on an installation or a target structure, the gangway comprising an end effector unit having an outer surface at least a certain portion of which is adapted to be in contact with the installation; the method comprising the steps of:

- Registering an initial landing position on the target structure around the time when a distal end of the gangway contacts with the installation or the target structure; the initial landing position being recorded by a sensor located in or around the end effector unit
- Comparing using a processing unit the initial landing position with the desired position and generating from the processing unit an initial error signal relative to the difference between the initial landing position and the desired position; the initial landing position being represented by an output of the sensor, and the desired position being represented by a predetermined reference signal
- Effecting a movement in the gangway for minimizing the error signal without disconnecting the distal end from the installation; the movement being effected by an actuator in response to the error signal for aligning the distal end substantially close to the desired position.

The method may further comprise the steps of:

- Measuring using the sensor a position of the distal end while the distal end is in contact with the installation or the target structure; the position representing a drift of the distal end from the desired position
- Comparing the position with the desired position and generating using the processing unit an second error signal relative to the difference between the position and the desired position
- Effecting a second movement in the gangway for minimizing the second error signal without disconnecting the distal end from the installation; the second movement being effected by the actuator in response to the second error signal for aligning the distal end substantially close to the desired position.

The movement in the gangway may be effected using a slew actuator driven by a slew controller. Additionally or alternatively, the movement in the gangway is effected using the end effector unit. In other words, the actuator may be a slew actuator driven by a slew controller and/or the actuator is an end effector unit actuator.

Present teachings can also provide a vessel or watercraft comprising a gangway as herein disclosed. The vessel can be any kind of ship, boat, hovercraft or such a watercraft suitable for transport on or in water.

Present teachings can also provide an installation, fixed or floating, in water or on land, comprising a gangway as herein disclosed.

Present teachings can also provide a computer software product for implementing any method steps disclosed herein. Accordingly, the present teachings also relate to a computer readable program code having specific capabilities for executing any method steps herein disclosed. In other words, the present teachings relate also to a non-transitory computer readable medium storing a program causing an electronic device to execute any method steps herein disclosed.

Various embodiments have been described above for a method for controlling a gangway, and for a gangway. Those skilled in the art will understand, however that changes and modifications may be made to those examples without departing from the spirit and scope of the following claims and their equivalents. It will further be appreciated that aspects from the method and product embodiments discussed herein may be freely combined.

Certain embodiments of the present teachings are further summarized in the following clauses.

Clause 1.

A gangway comprising a distal end on which an end effector unit is attached, the end effector having an outer surface at least a certain portion of which is configured to be in contact with an installation;

the end effector unit also comprising a sensor, wherein a movement of a rotatable element in the end effector unit corresponds to a movement of the distal end with respect to a reference point on the installation when the end effector unit is in contact with the installation, the movement of the distal end being at least along one of the axes related to the installation;

the sensor being configured to provide at least one output signal dependent upon the position of the distal end with respect to a desired location on the installation; and the gangway also being operatively linked to an actuator; wherein the actuator is configured to effect movement in the distal end for positioning the distal end at least substantially close to the desired location on the installation.

Clause 2.

Gangway according to clause 1, wherein the rotatable element is a wheel.

Clause 3.

Gangway according to clause 2, wherein the wheel is a semi-wheel.

Clause 4.

Gangway according to clause 2, wherein the wheel is an omni-wheel.

Clause 5.

Gangway according to clause 1, wherein the rotatable element is essentially spherical, such as a ball.

Clause 6.

Gangway according to any of the above clauses, wherein at least one of the at least one output signal of the sensor is dependent upon to the movement of the rotatable element.

Clause 7.

Gangway according to any of the above clauses, wherein the rotatable element is mounted in a rotatable mechanism, said rotatable mechanism being adapted to alter an axis of rotation of the rotatable element with respect to an axis of the base of the gangway.

Clause 8.

Gangway according to clause 1, wherein the rotatable element is a wheel-belt system.

Clause 9.

Gangway according to clause 8, wherein the wheel-belt system comprises a plurality of wheels.

Clause 10.

Gangway according to any of the above clauses, wherein the rotatable element is coupled to a force sensor, the force sensor being configured to output a force signal indicative of a force with which the rotatable element is pushed against the installation.

Clause 11.

Gangway according to any of the above clauses, wherein the rotatable element is coupled to a position sensor, the position sensor being configured to output a position signal indicative of a position of the rotatable element with respect to a position reference point.

Clause 12.

Gangway according to clause 11, wherein the rotatable element is coupled to a velocity sensor, the velocity sensor being configured to output a velocity signal indicative of a velocity related to a rotation of the rotatable element.

Clause 13.

Gangway according to any of the above clauses, wherein the actuator is a slew actuator of the gangway.

Clause 14.

Gangway according to any of the above clauses, wherein the actuator is controlled by a dynamic positioning (DP) system.

Clause 15.

Gangway according to any of the above clauses 1-12, wherein the end effector unit comprises a rotatable element actuator, the actuator being the rotatable element actuator, wherein when the end effector unit is in contact with the installation, the rotatable element actuator is configured to effect movement in the rotatable element for positioning the distal end at least substantially close to a desired location on the installation.

Clause 16.

Gangway according clause 15, wherein the gangway further comprises a slew actuator, and the gangway is configured to operate in a coordinated control mode in which the slew actuator and the rotatable element actuator are configured to operate in a control mode in which said actuators coordinatively effect the movement in the distal end.

Clause 17.

Gangway according clause 16, wherein the control mode is a full passive mode in which mode the slew actuator is configured to disengage from driving the distal end, or from retaining the distal end at a given position.

Clause 18.

Gangway according clause 16, wherein the control mode is a headroom passive mode in which mode the slew actuator is configured to disengage between a predetermined movement range of the distal end.

Clause 19.

Gangway according clause 16, wherein the control mode is an assisted mode in which mode the slew actuator is configured assist the rotatable element actuator for effecting the movement in the distal end.

Clause 20.

Gangway according to any of the above clauses, wherein the end effector unit is configured to be in contact with the installation with a predetermined transversal force.

Clause 21.

Gangway according to clause 20, wherein the gangway also comprises a controller, the controller being configured to regulate the predetermined transversal force.

Clause 22.

Gangway according to any of the clauses 20 and 21, wherein the predetermined transversal force is calculated based upon at least some of the system parameters including, any one or more parameters from: prevailing environmental conditions, properties of the installation surface, and properties of the outer surface.

Clause 23.

Gangway according to clause 22, wherein a landing site on the installation is selected based upon the at least one of the parameters related to the prevailing environmental conditions.

Clause 24.

Gangway according to any of the above clauses 13-23, wherein when the end effector unit is in contact with the installation, a slew controller is configured to at least partially minimize a lateral force acting between the distal end and the installation, the slew controller being functionally connected to the slew actuator.

Clause 25.

Gangway according to any of the above clauses, wherein the end effector unit is operatively coupled to an anti-slip system, the anti-slip system comprising an anti-slip controller receiving input from at least one sensor, and the anti-slip system being adapted to control at least one of the actuators in the end effector unit.

Clause 26.

Gangway according to any of the above clauses 21-24, wherein the controller and the anti-slip controller are a common controller.

Clause 27.

Gangway according to any of the above clauses, wherein the gangway further comprises a secondary position sensor.

Clause 28.

Gangway according to clauses 25 and 27, wherein the anti-slip system is configured to receive at least one secondary position signal from the secondary position sensor.

Clause 29.

Gangway according to any of the clauses 27 or 28, wherein the secondary position sensor is a camera.

Clause 30.

Gangway according to any of the above clauses, wherein the outer surface is at least partially composed of a resilient material.

Clause 31.

Gangway according to any of the above clauses, wherein the gangway, or the end effector unit, also comprises an end effector unit controller, the end effector unit controller being operatively connected to the rotatable element actuator for controlling the rotatable element actuator.

Clause 32.

Gangway according to clause 31, wherein at least one of, the end effector controller, and the slew controller is configured to coordinatively operate with a gangway controller.

Clause 33.

Gangway according to any of clauses 14-31 and 32, wherein at least one of the end effector unit controller, the slew controller, and the gangway controller is configured to coordinatively operate with the DP system.

Clause 34.

A gangway comprising a distal end on which an end effector unit is attached, the end effector unit having an outer surface at least a certain portion of which is adapted to be in contact with an installation, wherein a movement of a rotatable element in the end effector unit corresponds to a movement of the distal end with respect to a reference point on the installation when the end effector unit is in contact with the installation, the movement of the distal end being at least along one of the axes related to the installation.

Clause 35.

A method for repositioning a gangway distal end substantially close to a desired position on an installation or a target structure, the gangway comprising an end effector unit having an outer surface at least a certain portion of which is adapted to be in contact with the installation; the method comprising the steps of:

Registering an initial landing position on the target structure around the time when a distal end of the gangway contacts with the installation or the target structure; the initial landing position being recorded by a sensor located in the end effector unit Comparing using a processing unit the initial landing position with the desired position and generating from the processing unit an initial error signal relative to the difference between the initial landing position and the desired position; the initial landing position being represented by an output of the sensor, and the desired position being represented by a predetermined reference signal Effecting a movement in the gangway for minimizing the error signal without disconnecting the distal end from the installation; the movement being effected by an actuator in response to the error signal for aligning the distal end substantially close to the desired position.

Clause 36.

Method according to clause 35, wherein the method further comprises the steps of:

Measuring using the sensor a position of the distal end while the distal end is in contact with the installation or the target structure; the position representing a drift of the distal end from the desired position Comparing the position with the desired position and generating using the processing unit an second error signal relative to the difference between the position and the desired position Effecting a second movement in the gangway for minimizing the second error signal without disconnecting the distal end from the installation; the second movement being effected by the actuator in response to the second error signal for aligning the distal end substantially close to the desired position.

Clause 37.

Method according to any of the clauses 35-36, wherein the actuator is a slew actuator driven by a slew controller.

Clause 38.

Method according to any of the clauses 35-36, wherein the actuator is an end effector unit actuator.

Clause 39.

A vessel or watercraft comprising a gangway according to any of the clauses 1-34.

Clause 40.

An installation, floating or fixed, comprising a gangway according to any of the clauses 1-34.

The invention claimed is:

1. A gangway comprising:

a distal end;

an end effector unit attached to the distal end;

wherein the end effector unit has an outer surface along an axis of the gangway, at least a certain portion of the end effector unit being configured to be in contact with an installation, the gangway being configured to provide a force transversal to the axis along the gangway against the installation via the end effector unit;

wherein a movement of a rotatable element in the end effector unit corresponds to a movement of the distal end with respect to a reference point on the installation when the end effector unit is in contact with the installation;

wherein the movement of the distal end is at least along one of the axes related to the installation;

wherein the sensor is configured to provide at least one output signal dependent upon the position of the distal end with respect to a desired location on the installation;

wherein the gangway is operatively linked to an actuator; and wherein the actuator is configured to effect movement in the distal end for positioning the distal end at least substantially close to the desired location on the installation.

2. The gangway according to claim 1, wherein the rotatable element is essentially spherical.

3. The gangway according to claim 1, wherein at least one of the at least one output signal of the sensor is dependent upon to the movement of the rotatable element.

4. The gangway according to claim 1, wherein the rotatable element is mounted in a rotatable mechanism, the rotatable mechanism being adapted to alter an axis of rotation of the rotatable element with respect to an axis of the base of the gangway.

5. The gangway according to claim 1, wherein the rotatable element is coupled to a force sensor, the force sensor being configured to output a force signal indicative of a force with which the rotatable element is pushed against the installation.

6. The gangway according to claim 1, wherein the actuator is a slew actuator of the gangway.

7. The gangway according to claim 1, wherein the actuator is controlled by a dynamic positioning (DP) system.

8. The gangway according to claim 1, wherein the end effector unit comprises a sensor that measures the transversal force.

9. The gangway according to claim 1, wherein the rotatable element is a wheel.

10. The gangway according to claim 9, wherein the wheel is a semi-wheel.

11. The gangway according to claim 9, wherein the wheel is an omni-wheel.

12. The gangway according to claim 1, wherein the rotatable element is a wheel-belt system.

13. The gangway according to claim 12, wherein the wheel-belt system comprises a plurality of wheels.

14. The gangway according to claim 1, wherein the rotatable element is coupled to a position sensor, the position sensor being configured to output a position signal indicative of a position of the rotatable element with respect to a position reference point.

15. The gangway according to claim 14, wherein the rotatable element is coupled to a velocity sensor, the velocity sensor being configured to output a velocity signal indicative of a velocity related to a rotation of the rotatable element.

16. The gangway according to claim 1, wherein the end effector unit comprises a rotatable element actuator, the actuator being the rotatable element actuator, wherein when the end effector unit is in contact with the installation, the rotatable element actuator is configured to effect movement in the rotatable element for positioning the distal end at least substantially close to a desired location on the installation.

17. The gangway according to claim 16, wherein the gangway further comprises a slew actuator, and the gangway is configured to operate in a coordinated control mode in which the slew actuator and the rotatable element actuator are configured to operate in a control mode in which the actuators coordinatively effect the movement in the distal end.

18. The gangway according to claim 17, wherein the control mode is a full passive mode in which mode the slew actuator is configured to disengage from driving the distal end, or from retaining the distal end at a given position.

19. The gangway according to claim 17, wherein the control mode is a headroom passive mode in which mode the slew actuator is configured to disengage between a predetermined movement range of the distal end.

20. The gangway according to claim 17, wherein the control mode is an assisted mode in which mode the slew actuator is configured assist the rotatable element actuator for effecting the movement in the distal end.

* * * * *